US011050140B2

(12) United States Patent
Khripkov et al.

(10) Patent No.: US 11,050,140 B2
(45) **Date of Patent: *Jun. 29, 2021**

(54) WIRELESS COMMUNICATION SYSTEM INCLUDING POLARIZATION-AGILE PHASED-ARRAY ANTENNA

(71) Applicant: Samsung Electronics Co., Ltd., Suwon-si (KR)

(72) Inventors: Alexander Nikolaevich Khripkov, Lobnya (RU); Gennadiy Alexandrovich Evtyushkin, Moscow (RU); Anton Sergeevich Lukyanov, Moscow (RU); Won-Bin Hong, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/725,454

(22) Filed: Dec. 23, 2019

(65) Prior Publication Data

US 2020/0161745 A1 May 21, 2020

Related U.S. Application Data

(63) Continuation of application No. 15/366,358, filed on Dec. 1, 2016, now Pat. No. 10,516,201.

(30) Foreign Application Priority Data

Apr. 11, 2016 (RU) ..... 2016113669
Aug. 22, 2016 (KR) ..... 10-2016-0106383

(51) Int. Cl.
*H01Q 1/24* (2006.01)
*H01Q 21/24* (2006.01)
(Continued)

(52) U.S. Cl.
CPC ..... *H01Q 1/243* (2013.01); *H01Q 1/38* (2013.01); *H01Q 1/526* (2013.01); *H01Q 13/106* (2013.01); *H01Q 21/24* (2013.01)

(58) Field of Classification Search
CPC ..... H01Q 1/243; H01Q 21/24; H01Q 13/106; H01Q 1/38; H01Q 1/526; H01Q 3/40; H01Q 21/064; H01Q 13/085
See application file for complete search history.

(56) References Cited

U.S. PATENT DOCUMENTS 5,461,392 A 10/1995 Mott et al.
5,757,331 A 5/1998 Yoneyama et al.
(Continued)

FOREIGN PATENT DOCUMENTS

CN 204947073 U 1/2016
EP 1964209 B1 9/2008

OTHER PUBLICATIONS

Chinese Office Action dated Mar. 30, 2020, issued in a counterpart Chinese Application No. 201680084451.5.
(Continued)

*Primary Examiner* — Dieu Hien T Duong
(74) *Attorney, Agent, or Firm* — Jefferson IP Law, LLP

(57) ABSTRACT

A wireless communication device is provided. The wireless communication device includes a millimeter wave antenna comprising a plurality of antenna elements, a radio frequency integrated circuit (RFIC), and a power feeding line, wherein the plurality of antenna elements are dual-type antenna elements configured to excite different polarization modes, and wherein the power feeding line allows a plurality of ports of the RFIC to individually connect to the plurality of dual-type antenna elements to excite the different polarization modes to perform beamforming. The wireless com-
(Continued)

munication device and/or electronic device may be diversified according to various embodiments.

19 Claims, 21 Drawing Sheets

(51) Int. Cl.

| | |
|---|---|
| ***H01Q 13/10*** | (2006.01) |
| ***H01Q 1/38*** | (2006.01) |
| ***H01Q 1/52*** | (2006.01) |

(56) References Cited

U.S. PATENT DOCUMENTS

| | | | | |
|---|---|---|---|---|
| 7,589,689 | B2 | 9/2009 | Welch et al. | |
| 10,516,201 | B2 * | 12/2019 | Khripkov | H01Q 13/106 |
| 2005/0200533 | A1 | 9/2005 | Brown et al. | |
| 2013/0278468 | A1 | 10/2013 | Yehezkely et al. | |
| 2015/0214633 | A1 | 7/2015 | Pan | |
| 2016/0049723 | A1 | 2/2016 | Baks et al. | |
| 2016/0087348 | A1 | 3/2016 | Ko et al. | |

OTHER PUBLICATIONS

Extended European Search Report; Application No. 16898754.3-1205 / 3427342 PCT/KR2016014287; dated Feb. 11, 2019.

* cited by examiner

WIRELESS COMMUNICATION SYSTEM INCLUDING POLARIZATION-AGILE PHASED-ARRAY ANTENNA

CROSS-REFERENCE TO RELATED APPLICATION(S)

This application is a continuation application of prior application Ser. No. 15/366,358 filed on Dec. 1, 2016, which will be issued as U.S. Pat. No. 10,516,201 on Dec. 24, 2019, and claimed the benefit under 35 U.S.C. § 119(a) of a Russian patent application filed on Apr. 11, 2016 in the Russian Patent Office and assigned Serial number 2016113669, and of a Korean patent application filed on Aug. 22, 2016 in the Korean Intellectual Property Office and assigned Serial number 10-2016-0106383, the entire disclosure of each of which is hereby incorporated by reference.

TECHNICAL FIELD

The present disclosure relates to antenna devices. More particularly, the present disclosure relates to antenna devices capable of transmitting and receiving millimeter waves (mmWaves) according to polarization variations and wireless communication devices including the same.

BACKGROUND

The fifth generation (5G) era has happened to provide expanded performance and access to electronic devices and various user experiences by implementing easier linkage to nearby devices (e.g., wireless access) and enhanced energy efficiency. In wireless access techniques operated on millimeter wave (mmWave) frequencies, a majority of basic issues in antenna array physics and high-speed transceiver design and equalizer design have already been shown in WiGig/802.11ad standards. Wireless communication devices supportive of fourth generation (4G)/5G mobile networks or wireless local area mobile networks (e.g., wireless local area network (LAN)) may change their position as the users move, and they may thus require a wide beam scanning scope to provide stable communication channels.

In equipping mmWave antennas in wireless communication devices, manufacturing costs, power efficiency, ease to make compact, or stabilized access may be taken into account. For example, as communication frequency bands increase, radio frequency integrated circuits (RFICs) may experience increased propagation loss or high-level noise factors. Forced boosting of the antenna gain may lead to stabilized access but may deteriorate the power efficiency. As another example, stabilized access may require a wide beam forming and beam scanning range. However, since the directivity increases as the communication frequency band rises up, the beam forming and beam scanning range may be reduced.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide antenna devices capable of transmitting and receiving millimeter waves (mmWaves) according to polarization variations and wireless communication devices including the same.

In accordance with an aspect of the present disclosure, an mmWave antenna operated on a high frequency band of a few tens of GHz, wherein a radio frequency integrated circuit (RFIC) and a radiation conductor are integrated in a module on a single circuit board is provided. Such antenna module may not only run on a significantly high frequency band but may also provide excellent power efficiency, wide beam forming and beam scanning range to thereby allow for stabilized access to a communication network. Further, it may be easily made smaller and may thus be equipped in a compact wireless communication device and/or electronic device.

In accordance with another aspect of the present disclosure, an antenna module capable of providing stabilized communication network access through electrical harmony with the ambient metal structure or dielectric structures and wireless communication device (or electronic device) including the same is provided.

In accordance with another aspect of the present disclosure, a wireless communication device and/or electronic device is provided. The wireless communication device and/or electronic device includes an antenna device (e.g., a polarization-agile phased-array antenna), a mmWave antenna comprises a plurality of antenna elements, an RFIC, and a power feeding line, wherein the plurality of antenna elements are dual-type antenna elements configured to excite different polarization modes, and wherein the power feeding line allows a plurality of ports of the RFIC to individually connect to the plurality of dual-type antenna elements to excite the different polarization modes to perform beamforming.

In accordance with another aspect of the present disclosure, an antenna is provided. The antenna includes a substrate, a plurality of first antenna elements arranged in a first direction and exciting a first polarization mode, a plurality of second antenna elements arranged in a second direction and exciting a second polarization mode different from the first polarization mode, a plurality of first power feeding lines connected with the first antenna elements, and a plurality of second power feeding lines connected with the second antenna elements, wherein the plurality of first antenna elements and the plurality of second antenna elements are alternately arranged on the substrate.

In accordance with another aspect of the present disclosure, a wireless communication device and/or electronic device is provided. The wireless communication device and/or electronic device comprises an antenna device (e.g., a polarization-agile phased-array antenna) comprising a mmWave comprising a plurality of antenna elements and a housing including at least one opening matching the mmWave antenna with an outer space. The mmWave antenna comprises an RFIC, and a power feeding line, wherein the plurality of antenna elements are dual-type antenna elements configured to excite polarization modes orthogonal to each other, wherein the power feeding line are configured to individually couple a plurality of ports of the RFIC to individually connect to the plurality of dual-type antenna elements to excite the orthogonal polarization modes to perform beamforming, and wherein the mmWave antenna is separated from the outer space by the housing and is configured to radiate an electromagnetic wave through conductive patterns of the housing to the outer space.

According to an embodiment of the present disclosure, the antenna elements arranged in the mmWave antenna may configure a phase array antenna to transmit and receive mmWaves and may electrically couple with the conductive structure (e.g., a metal frame including at least one opening) provided in the wireless communication device and/or electronic device.

According to an embodiment of the present disclosure, polarization-variation phased array antennas may have different types independently implemented in the same antenna element, providing control of dual-polarization radiation beam forming.

According to an embodiment of the present disclosure, at least one beamforming mode among an array mode by an array of antenna elements, a leaky wave mode by a leaky wave radiator configured through the conductive structure, and a mixed mode of the array mode and the leaky wave mode may be operated, thereby allowing for a wide beamforming and beam scanning range.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
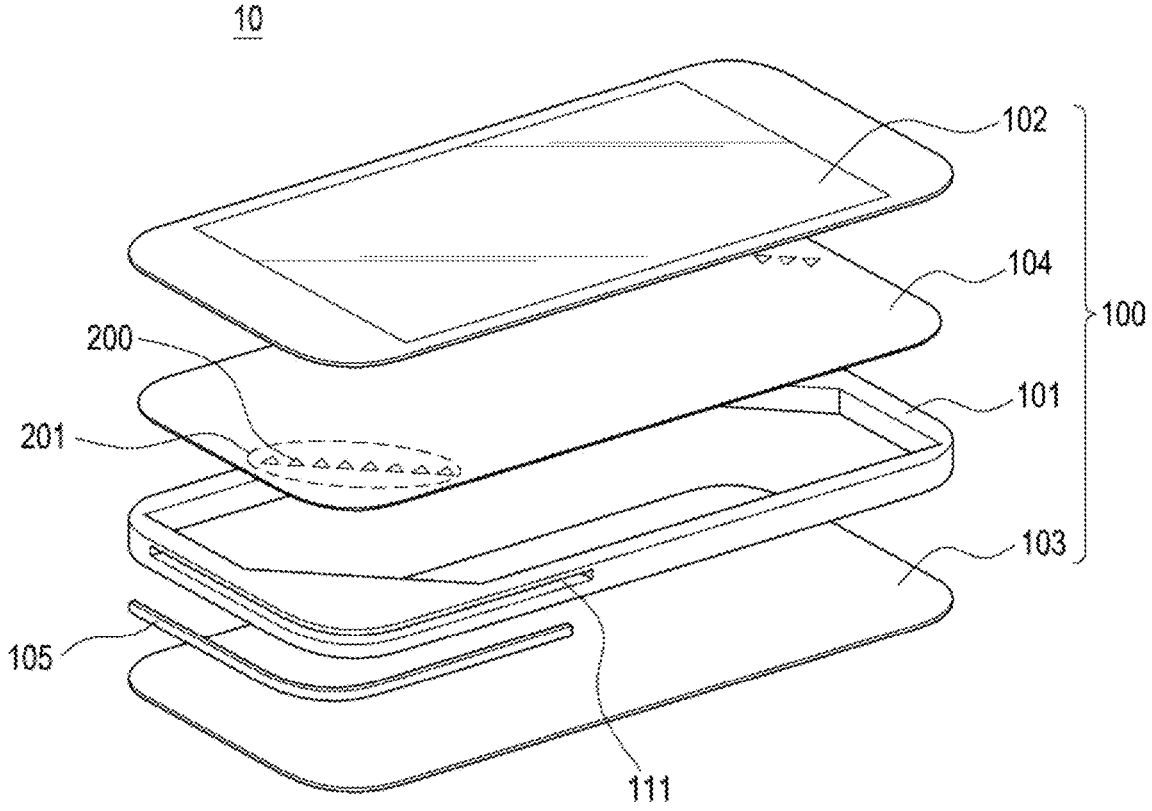
FIG. 1 is an exploded perspective view illustrating a wireless communication device and/or electronic device according to an embodiment of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The terms coming with ordinal numbers such as 'first' and 'second' may be used to denote various components, but the components are not limited by the terms. The terms are used only to distinguish one component from another. For example, a first component may be denoted a second component, and vice versa without departing from the scope of the present disclosure. The term "and/or" may denote a combination(s) of a plurality of related items as listed or any of the items.

The terms "front," "rear surface," "upper surface," and "lower surface" are relative ones that may be varied depending on directions in which the figures are viewed, and may be replaced with ordinal numbers such as "first" and "second." The order denoted by the ordinal numbers, first and second, may be varied as necessary.

It will be further understood that the terms "comprise" and/or "have," when used in this specification, specify the presence of stated features, integers, operations, elements, and/or components, but do not preclude the presence or addition of one or more other features, integers, operations, elements, components, and/or groups thereof.

Unless otherwise defined, all terms including technical and scientific terms used herein have the same meaning as commonly understood by one of ordinary skill in the art to which the various embodiments of the present disclosure belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, the term "electronic device" may be any device with a touch panel, and the electronic device may also be referred to as a terminal, a portable terminal, a mobile terminal, a communication terminal, a portable communication terminal, a portable mobile terminal, or a display apparatus.

For example, the electronic device may be a smartphone, a mobile phone, a navigation device, a game device, a television (TV), a head unit for vehicles, a laptop computer, a tablet computer, a personal media player (PMP), or a personal digital assistant (PDA). The electronic device may be implemented as a pocket-sized portable communication terminal with a radio communication function. According to an embodiment of the present disclosure, the electronic device may be a flexible device or a flexible display.

The electronic device may communicate with an external electronic device, e.g., a server, or may perform tasks by interworking with such an external electronic device. For example, the electronic device may transmit an image captured by a camera and/or location information detected by a sensor to a server through a network. The network may include, but is not limited to, a mobile or cellular communication network, a local area network (LAN), a wireless LAN (WLAN), a wide area network (WAN), the internet, or a small area network (SAN).

According to an embodiment of the present disclosure, a wireless communication device and/or electronic device may electromagnetically combine an antenna module including a plurality of antenna elements with a conductive structure (including at least one opening) of a case or housing.

In the wireless communication system and/or electronic device, the phased array antenna module may be polarization-agile, operated on a millimeter wave (mmWave) frequency, and provide both vertical and horizontal beamforming on an electronic device such as a mobile device. According to an embodiment of the present disclosure, the dual-type antenna array devices may be provided in an aperture radiation-type structure and/or travelling radiation-type structure.

According to an embodiment of the present disclosure, independently forming different radiation types (aperture radiation type and/or travelling radiation type) in the same antenna element may provide dual-polarization radiation beamforming. The aperture radiation type and/or travelling radiation type formed in the different structures may form their respective corresponding polarization radiations. For example, a vertical polarization radiation may be formed by the aperture radiation type structure, and a horizontal polarization radiation may be formed by the travelling wave radiation type structure.

The above-mentioned wireless communication device and/or electronic device may be operated in any one beamforming mode among an array mode by an array of antenna elements, a leaky wave mode by a conductive structure, and a mixed mode according to a combination of the array mode and the leaky wave mode, thereby allowing for a wide beamforming and beam scanning range.

According to an embodiment of the present disclosure, the antenna element and/or antenna module for configuring a mmWave dual-type antenna may be accommodated in the housing of the electronic device, and radio waves radiated from the antenna elements should be able to be transmitted through the metallic portion or dielectric portion of the housing.

According to an embodiment of the present disclosure, when the thickness (t) of the metallic portion or dielectric portion meets the following Equation 1, wireless signals may be transmitted through the metallic portion or dielectric portion of the housing.

$$t \leq \lambda_c / 4 / \sqrt{\varepsilon_r} \qquad \text{Equation 1}$$

Here, λc is the wavelength at the center frequency, e.g., 60.5 GHz. Upon adopting a typical dielectric constant εr, wireless signals may be smoothly transmitted when the metallic portion or dielectric portion of the housing is about 690 μm thick or less.

According to an embodiment of the present disclosure, the wireless communication system and/or electronic device may have the following features.

The wireless communication system and/or electronic device according to the present disclosure may be a brand-new dual-type antenna where a horizontally polarized travelling wave-type antenna may be formed as a part of a vertically polarized aperture-type antenna to simultaneously provide a vertical polarization radiation and horizontal polarization radiation. Conventionally, there is no structure in which travelling wave-type and aperture-type antennas are integrated in the same aperture, as in the present disclosure.

According to the present disclosure, the polarization phase controlled leaky wave antenna array in the wireless communication device and/or electronic device may provide a plurality of beamforming modes. For example, in the array mode where the antenna elements themselves radiate wireless signals, mmWave transmission and reception may be carried out through phase power feeding to each antenna element, and in the mixed mode or leaky wave mode, at least part of electromagnetic energy radiated from the antenna elements may be focused onto the leaky wave structure so that mmWave signals may be radiated by the leaky wave structure to the free space. There are no conventional phase controlled antenna structures that are operated in multiple modes, as in the present disclosure.

According to the present disclosure, the wireless communication device and/or electronic device may implement array antennas coupled to the dielectric and/or metallic structures of the wireless communication device and/or electronic device.

According to an embodiment of the present disclosure, the wireless communication device and/or electronic device may implement a leaky wave structure (e.g., a leaky wave radiator or leaky wave phase array antenna) and combine the leaky wave structure with the antenna elements by forming at least one opening in the conductive structure of the housing. The combination of the leaky wave structure and antenna element array may diversify beamforming modes.

According to an embodiment of the present disclosure, the antenna elements in the array mode may radiate wireless signals through the opening formed in the conductive structure of the housing. The leaky wave phase array antenna may perform beamforming and beam scanning in a different direction and/or angle than in the array mode. For example, according to an embodiment of the present disclosure, the wireless communication device and/or electronic device may secure a wider beamforming and beam scanning range by selectively operating the array mode and leaky wave mode. In some embodiments, while the leaky wave phase array antenna runs, the antenna elements may radiate wireless signals through the opening, so that the wireless communication device and/or electronic device according to an embodiment of the present disclosure may conduct beamforming in the mixed mode of the array mode and the leaky wave mode. Accordingly, according to an embodiment of the present disclosure, the wireless communication device and/or electronic device may secure a wide beamforming and beam scanning range even on a high communication frequency band of a few tens of GHz or more.

FIG. 1 is an exploded perspective view illustrating a wireless communication device and/or electronic device according to an embodiment of the present disclosure.

Referring to FIG. 1, according to an embodiment of the present disclosure, a wireless communication device and/or electronic device 10 (hereinafter, "electronic device") may include a housing 100 including a metal frame 101 and at least one of a front cover 102 and/or rear cover 103 and a circuit board 104 received in the housing 100. In one embodiment, an antenna module of the electronic device 10 may include a plurality of dual-type antenna elements 200, and an array 201 of the dual-type antenna elements 200 may be formed on the circuit board 104. In some embodiment, the dual-type antenna elements 200 each may receive phase difference power feeding independently from one another. For example, the array 201 of the dual-type antenna elements 200 may form a phase array antenna. In another embodiment, the dual-type antenna elements 200, together with a radio frequency integrated circuit (RFIC), may be integrated on one circuit board (e.g., the circuit board 104).

According to an embodiment of the present disclosure, the metal frame 101 may generally have a closed loop shape and may include a conductive material at least partially. The rear cover 103 may be combined with the metal frame 101 to form a rear surface of the housing 100 and/or the electronic device 10. The rear cover 103 may be formed of a metallic material, such as aluminum or magnesium or a dielectric material, such as a synthetic resin. According to an embodiment of the present disclosure, the rear cover 103 and the metal frame 101 may be formed in a single body. For example, the rear cover 103 may be formed of the same material as the metal frame 101, or the rear cover 103, together with the metal frame 101, may be formed in a uni-body structure simultaneously with shape forming, without undergoing a separate assembling process through an insert molding process or so. The front cover 102 may be combined with the metal frame 101 in a direction opposite the rear cover 103 to form a front surface of the housing 100 and/or the electronic device 10. For example, the metal frame 101 may be provided to at least partially surround a space between the rear cover 103 and the front cover 102 and may form side wall(s) of the housing 100 and/or the electronic device 10. The front cover 102 may be, e.g., a display having a window glass and display device and/or touch panel integrated together.

The housing 100 may include at least one opening 111 formed to pass through a side wall, e.g., the metal frame 101. The opening(s) 111 may be formed on, e.g., the conductive structure of the metal frame 101. According to an embodiment of the present disclosure, the opening(s) 111 may be elongated slot(s) formed in one of the side walls of the housing 100, multiple ones, respectively, of the side walls of the housing 100, or two adjacent ones of the side walls of the housing 100. According to an embodiment of the present disclosure, a portion of the circuit board 104 and/or the dual-type antenna elements 200 may be received in the opening 111. At least a portion of the opening(s) 111 may be electromagnetically combined with the dual-type antenna elements 200 to form a leaky wave structure (e.g., a leaky wave phase array antenna), such as leaky wave structure 500 illustrated in FIG. 2A.

According to an embodiment of the present disclosure, a plurality of circular or polygonal openings may be arranged on a side wall (e.g., the conductive structure part of the metal frame 101) of the housing 100. The plurality of openings formed in the side wall of the housing 100 may be utilized as acoustic holes of the electronic device 10. For example, the openings may be utilized as microphone holes for inputting the user's voice or sound output holes outputting sound generated from a speaker module. According to an embodiment of the present disclosure, such acoustic holes, although not directly receiving the dual-type antenna elements 200, may be arranged adjacent to the dual-type antenna elements 200 or to the array 201 of the dual-type antenna elements 200. For example, the plurality of openings provided as acoustic holes, each, may be electromagnetically coupled with the dual-type antenna elements 200 to form a leaky wave structure (e.g., a leaky wave phase array antenna), such as leaky wave structure 500 illustrated in FIG. 2A.

According to an embodiment of the present disclosure, the circuit board 104 may be formed of one of a printed circuit board (PCB) or low temperature co-fired ceramic (LTCC) board. The dual-type antenna elements 200 may be configured of waveguide pipes, such as an aperture radiation-type structure 210 illustrated in FIG. 3A, arranged on at least one surface of the circuit board 104. When the circuit board 104 is a multi-layered circuit board, there may be included a grid structure including a combination of a via hole and/or conductive pattern formed in the multi-layered circuit board or a portion of the waveguide pipe formed on at least one layer of the circuit board 104. When the circuit board 104 is received in the housing 100, the dual-type antenna elements 200 may be received in the opening 111 or disposed adjacent to the opening 111.

According to an embodiment of the present disclosure, the housing 100, e.g., the opening 111, may have a beam deflector 105. The beam deflector 105 may be inserted from outside of the housing 100 to the opening 111. According to an embodiment of the present disclosure, the beam deflector 105 may include a body formed generally of a dielectric substance (e.g., synthetic resin) and a parasitic conductor formed in the body, and when inserted into the opening 111, a side surface thereof may be exposed to the free space (e.g., an external space of the housing 100). According to an embodiment of the present disclosure, the beam deflector 105 may be combined with the opening 111 to form a leaky wave structure (e.g., a leaky wave phase array antenna), such as leaky wave structure 500 illustrated in FIG. 2A. For example, upon transmission or reception of wireless signals through the dual-type antenna elements 200, the beam deflector 105 may be combined with the opening 111 to convert a flow of surface current generated in the conductive structure (e.g., the metal frame 101) into a leaky wave and radiate the leaky wave to the free space.

Figure 2A:
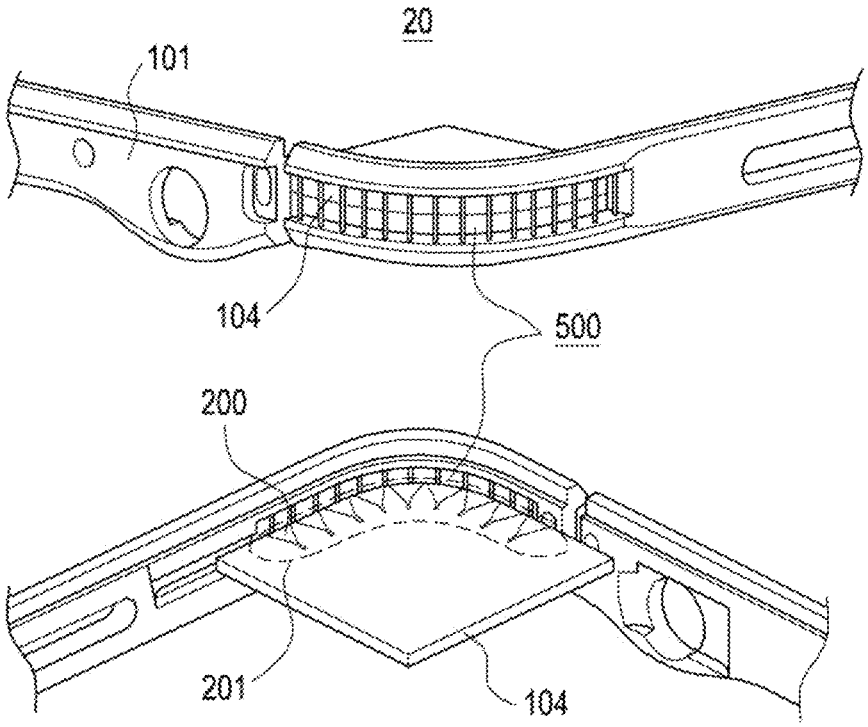
FIGS. 2A, 2B, and 2C are a perspective view and top views illustrating a portion of a wireless communication device and/or electronic device according to an embodiment of the present disclosure.
Figure 2B:
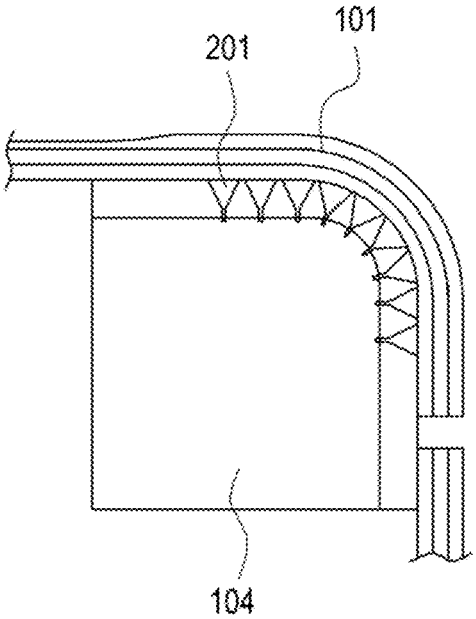
Figure 2C:
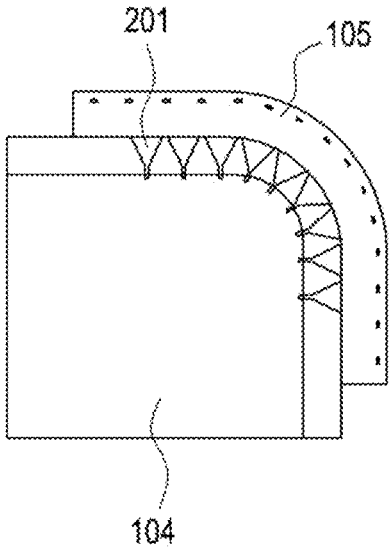

FIGS. 2A, 2B, and 2C are a perspective view and top views illustrating an antenna module of a wireless communication device and/or electronic device according to an embodiment of the present disclosure.

Referring to FIG. 2A, an antenna module 20 of the electronic device 10 includes the array 201 of dual-type antenna elements 200, which may be disposed adjacent to a side wall (e.g., a conductive structure portion of the metal frame 101) of the housing 100. The conductive structure portion of the metal frame 101 may form the leaky wave structure 500.

According to an embodiment of the present disclosure, the dual-type antenna elements 200 may be arranged along an inner edge of the electronic device 10 in an arc shape corresponding to the shape of the leaky wave structure 500. The dual-type antenna elements 200 may have, e.g., a waveguide shape, and may receive power from outside of the antenna elements through power feeding ports to provide vertical polarization radiation and/or horizontal polarization radiation. The power feeding ports may be provided in various locations depending on the radiation direction of wireless signals or installation environment of the array 201 including the dual-type antenna elements 200.

Referring to FIG. 2B, the array 201 including the dual-type antenna elements 200 may be disposed adjacent to a corner in a corresponding electronic device (e.g., the electronic device 10 of FIG. 1) and/or a corresponding housing (e.g., the housing 100 of FIG. 1) and may be disposed inside a corresponding opening (e.g., the opening 111 of FIG. 1) formed in a corresponding metal frame (e.g., the metal frame 101 of FIG. 1). Power feeding signals respectively provided to the power feeding ports may have a phase difference with respect to each other which allows, e.g., the radiation direction of wireless signals transmitted and received through the dual-type antenna elements 200 to be set in various manners. An equi-angular array, such as the array 201 including the dual-type antenna elements 200 as shown, may increase the beam scanning range.

Referring to FIG. 2C, the distance between the beam deflector 105, or of a corresponding inner structure of the metal frame 101, and the PCB 104 may be adjusted depending on mechanical requirements for anti-stress durability.

Figure 3A:
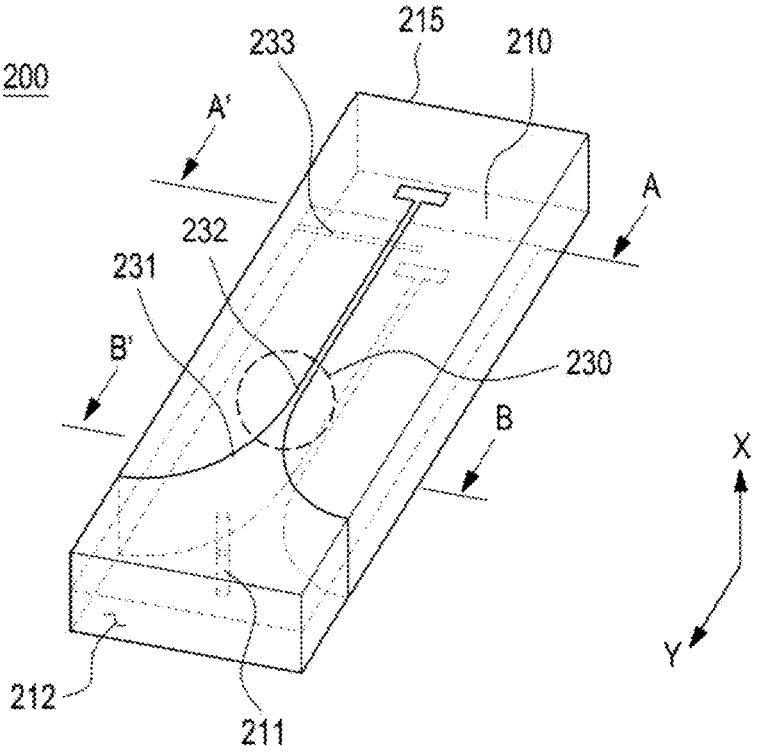
FIGS. 3A, 3B, and 3C are perspective views and a top view illustrating dual-type antenna elements and an array of the dual-type antenna elements according to an embodiment of the present disclosure.
Figure 3B:
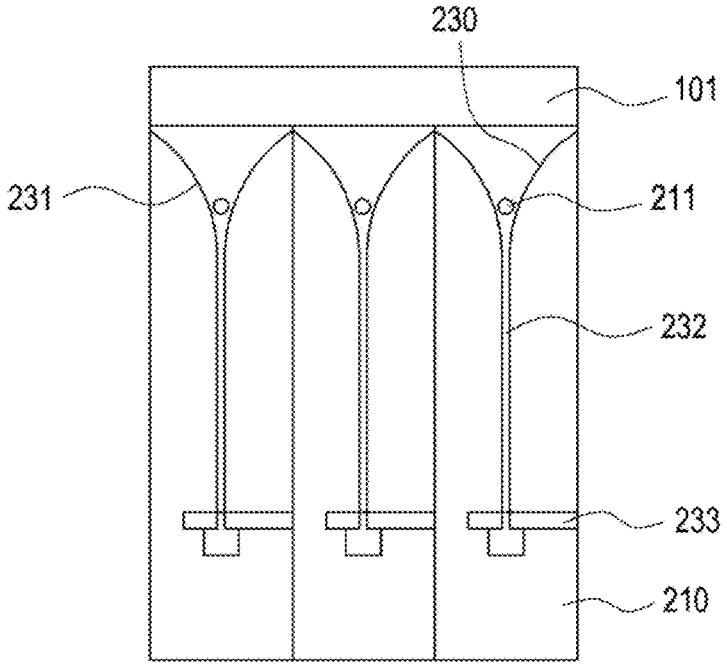
Figure 3C:
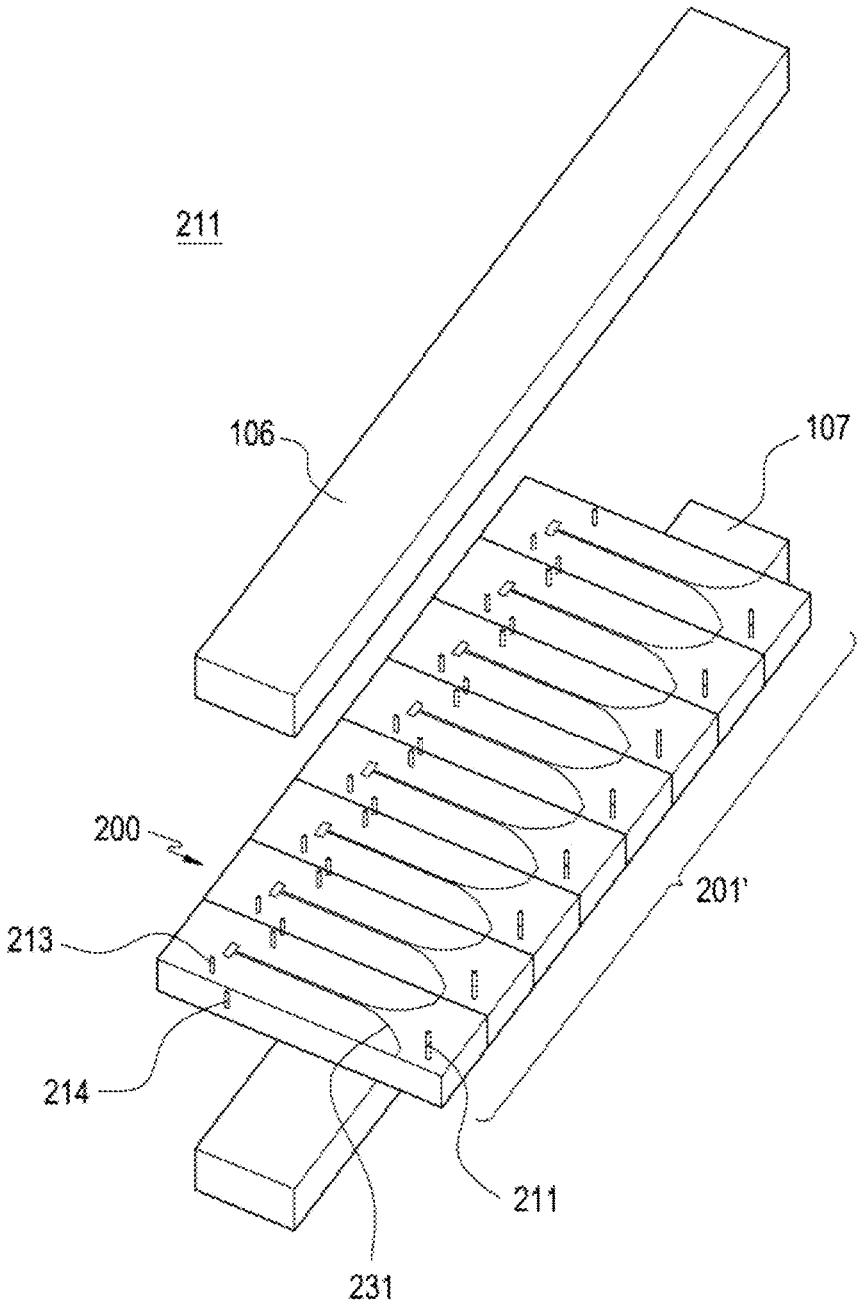

FIGS. 3A, 3B, and 3C are perspective views and a top view illustrating dual-type antenna elements and an array of the dual-type antenna elements according to an embodiment of the present disclosure.

According to the present disclosure, a mmWave monolithically integrated antenna module of an electronic device (e.g., the antenna module 20 of the electronic device 10 illustrated in FIGS. 2A, 2B, and 2C) may include the plurality of dual-type antenna elements 200, an RFIC (e.g., RFIC 300 illustrated in FIG. 10C), and power feeding lines 233.

According to an embodiment of the present disclosure, the dual-type antenna elements 200 may be configured to excite different polarization modes, and the power feeding lines 233 may be configured to individually connect a plurality of ports of the RFIC 300 to the dual-type antenna elements 200 to excite the different, separate polarization modes and carry out beamforming.

Referring to FIG. 3A, the dual-type antenna elements 200 may include an aperture radiation-type structure 210 and a travelling radiation-type structure 230 to enable radiation of electromagnetic waves as per the two separated polarization modes.

According to an embodiment of the present disclosure, the aperture radiation-type structure 210 may be provided in the form of a rectangular waveguide 215 having an aperture 212 formed in a surface thereof, and the traveling radiation-type structure 230 may be provided by slot lines 232 formed in a lengthwise surface of the waveguide shape of the waveguide 215.

According to an embodiment of the present disclosure, the aperture 212 of the aperture radiation-type structure 210 may provide a radiation polarized in a first direction (X), and the slot lines 232 formed in the waveguide 215 may provide a radiation polarized in a second direction (Y) orthogonal to the first direction X. For example, the aperture 212 provided at a side of the waveguide 215 may generate a vertical polarization radiation perpendicular to the lengthwise direction of the waveguide 215, and the slot lines 232 disposed at the center of the waveguide 215 may generate a horizontal polarization radiation.

According to an embodiment of the present disclosure, a vertical polarization radiation may be provided by the aperture radiation-type structure 210, and the aperture radiation-type structure 210 may be achieved by the waveguide 215 supportive of a TE10 mode. The vertical polarization radiation may be performed by the aperture 212 of the waveguide 215 matched with an outer space by an impedance transforming part 211 formed of a metal-dielectric.

According to an embodiment of the present disclosure, a horizontal polarization radiation may be provided by the traveling radiation-type structure 230, and the traveling radiation-type structure 230 may be achieved by non-radiative slot lines 232 formed in an upper surface of the waveguide 215. A power feeding line 233 disposed on a lower surface of the traveling radiation-type structure 230 may be disposed to connect with the waveguide 215 from a narrow wall to feed power to the slot line 232. For example, the slot line 232 may be disposed in the form of a tapered slot.

Referring to FIG. 3B, the array 201 of dual-type antenna elements 200 may be disposed to form a straight-line section on a PCB (e.g., the PCB 104 of FIG. 1). For example, the inner space of the housing 100 and the conductive structures forming the same may be electromagnetically combined with the dual-type antenna elements 200 and/or the array 201 of the dual-type antenna elements 200 to form a plurality of waveguide structures. The dual-type antenna elements 200 may receive power from the RFIC 300 through channels independent from each other, and they, along with their surrounding conductive structures, may form the plurality of waveguide structures. The power feeding line 233 receiving power from the RFIC 300 may include a first power feeding port 213 (illustrated in FIG. 3C) for vertical polarization radiation and a second power feeding port 214 for horizontal polarization radiation.

Referring to FIG. 3C, at least one metal screen 106 or 107 may be provided on the top and/or bottom of the array 201 of dual-type antenna elements 200. The metal screen 106 or 107 may be disposed adjacent to a conductive structure, e.g., the metal frame 101 (refer to FIG. 1).

The first metal screen 106 and the second metal screen 107 may be disposed adjacent to each other, with at least a portion of the circuit board 104, e.g., the dual-type antenna elements 200 (and/or the array 201 of the dual-type antenna elements 200) interposed therebetween.

According to an embodiment of the present disclosure, the first metal screen 106 and/or second metal screen 107 may be disposed in the metal frame 101 to enhance the hardness of the above-described electronic device. In another embodiment, the first metal screen 106 and/or second metal screen 107 may provide an electromagnetic shielding function between the circuit board 104 and other electronic parts therein (e.g., a display device). In another embodiment, the first metal screen 106 and/or second metal screen 107 may spatially and/or electromagnetically isolate various electronic parts (e.g., the processor, RFIC, audio module, power management module, etc.) arranged in the circuit board 104 from each other.

According to an embodiment of the present disclosure, the wide-band impedance matching characteristics in the dual-type antenna elements 200 may be attained by the following means: tapered slot profile for impedance transformation of horizontal polarization; metal-dielectric part formed to transform impedance of vertical polarization; and parasitic matching elements arranged at ends of the dual-type antenna elements 200.

According to an embodiment of the present disclosure, a decoupling between the aperture radiation-type structure 210 and the traveling radiation-type structure 230 may be achieved by the following means: since the strip line is a geometrical symmetry line and is perpendicular to the E-field of the TE10 mode, the TE10 mode might not be coupled to the strip line, and the traveling radiation-type structure 230 may be formed of symmetrical non-radiative slot lines at the center of broad side surfaces of the waveguide.

According to an embodiment of the present disclosure, the dual-type antenna elements 200 may be formed on the PCB 104 or in another embodiment may be formed on a monolithically integrated circuit board. Alternatively, the dual-type antenna elements 200 may be implemented of plastic pieces having conductors etched thereto.

Figure 4:
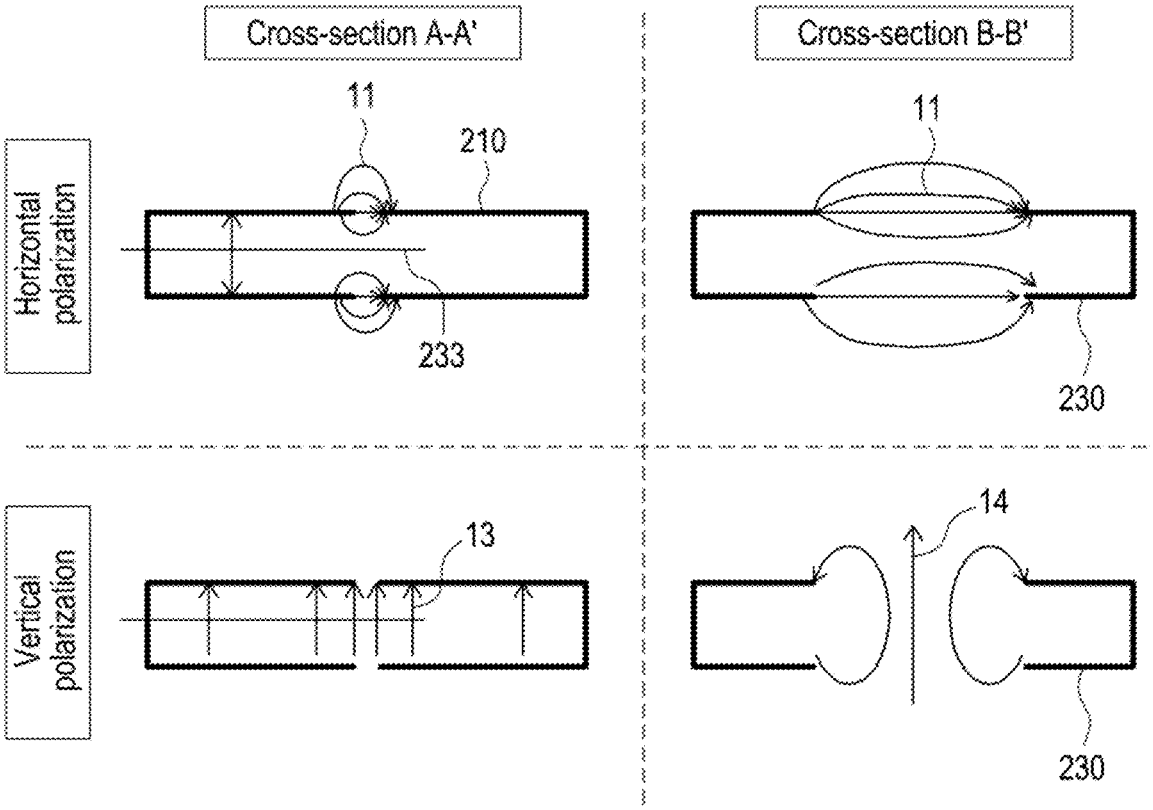
FIG. 4 illustrates cross sections of the dual-type antenna elements of FIG. 3A, taken along line A-A' and line B-B' to represent a polarization-variation of the dual-type antenna elements according to an embodiment of the present disclosure.

FIG. 4 illustrates cross sections of the dual-type antenna elements of FIG. 3A, taken along line A-A' and line B-B' to represent a polarization-variation of the dual-type antenna elements according to an embodiment of the present disclosure.

Referring to FIG. 4, electric field vectors 11 for representing a horizontal polarization radiation are distributed in metallic portions of the aperture radiation-type structure 210 and the second power feeding port 214 shaped as a slot-coupler line. According to an embodiment of the present disclosure, horizontal polarization mode electromagnetic waves may be verified to be radiated by the slot-coupler line, and the second power feeding port 214 may induce an electric current onto the slot line of the traveling radiation-type structure 230.

As an example, vertical polarization mode electromagnetic waves 13 and 14 may be generated by the aperture radiation-type structure 210 shaped as a rectangular waveguide port, and the electromagnetic waves 13 and 14 propagating through the slot structure may have a quasi TE10 mode.

Figure 5A:
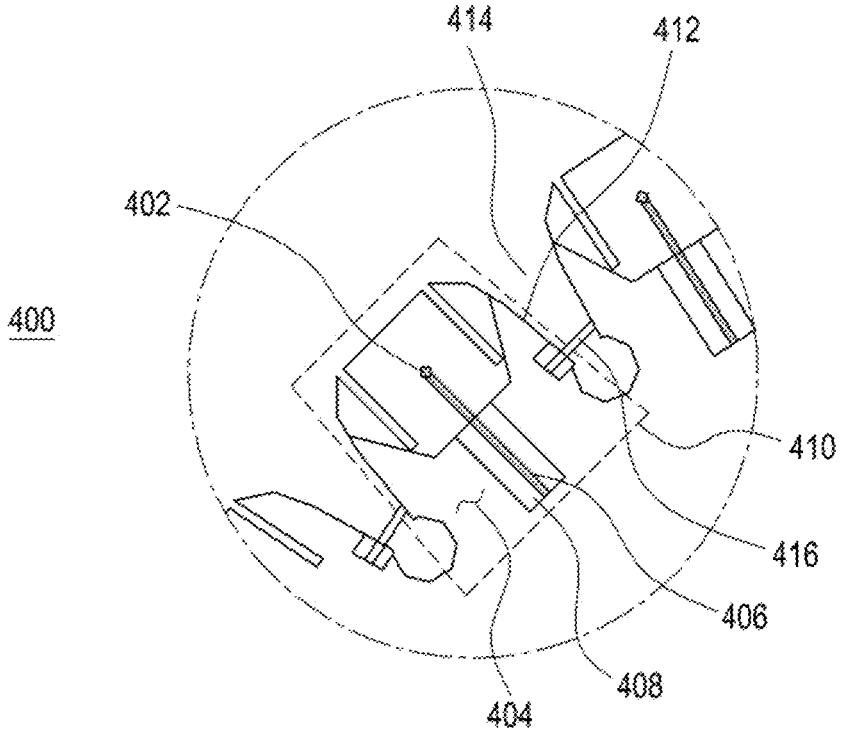
FIGS. 5A and 5B are a top view and a top perspective view illustrating an array of dual-type antenna elements for polarization diversity beamforming according to an embodiment of the present disclosure.
Figure 5B:
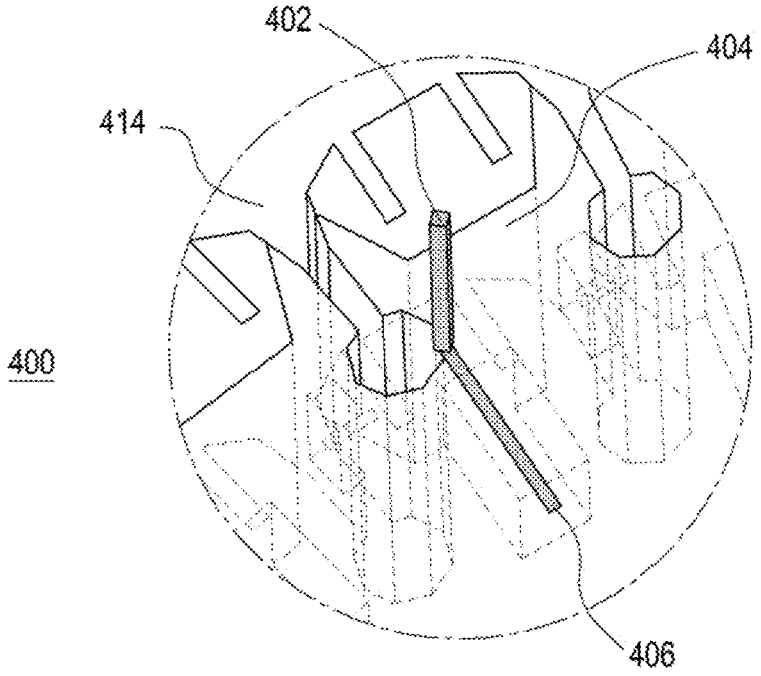

FIGS. 5A and 5B are a top view and a top perspective view illustrating an array of dual-type antenna elements for polarization diversity beamforming according to an embodiment of the present disclosure.

Referring to FIGS. 5A and 5B, an aperture radiation-type structure 400 may provide a vertical polarization radiation and may be formed by a first antenna 402. For example, the first antenna 402 may include a probe antenna disposed in the form of a column inside an aperture radiation-type structure 404 shaped as a horn antenna.

According to an embodiment of the present disclosure, the first antenna 402 may be fed power by the first power feeding port 406 disposed as a line towards the aperture 408 at a side 410 of the aperture radiation-type structure 404. The first power feeding port 406 may include a strip line. The first antenna 402 is fed power through the first power feeding port 406 extending from the power feeding line of a corresponding RFIC, and may radiate a vertical polarization towards the aperture 408.

According to an embodiment of the present disclosure, the horn antenna-shaped aperture radiation-type structure 404 may be surrounded by two conductive layers arranged at an upper and lower side and a surface of a second antenna 412 disposed at an outer side and shaped as a slot line which is described below, and an end of the first antenna 402 disposed inside the aperture radiation-type structure 404 may be connected with an end of the first power feeding port 406 to receive power.

According to an embodiment of the present disclosure, the first power feeding port 406 may be disposed in a line shape between tapered slots and may be formed on a PCB to directly provide an electrical connection.

A traveling radiation-type structure 414 may provide a horizontal polarization radiation and may be formed by the second antenna 412. For example, the second antenna 412 may be implemented in the form of a slot. According to an embodiment of the present disclosure, the second antenna 412 may be fed power by a second power feeding port 416 disposed to connect the tapered slot of the traveling radiation-type structure 414. The second power feeding port 233 may include a slot coupler strip line. The second antenna 412 fed power by the second power feeding port 416 extended by the power feeding line of the corresponding RFIC may radiate a horizontal polarization towards the opening of the slot.

According to an embodiment of the present disclosure, the second antenna 412 may be shaped as a tapered slot narrowing to the inside, and a plurality of second antennas 412 may be arranged at predetermined intervals. The second antenna 412 may include circular openings at inside ends therein. According to an embodiment of the present disclosure, the second power feeding port 413 may be disposed in a line shape connecting tapered slots and may be formed of a PCB to directly provide an electrical connection.

Figure 6A:
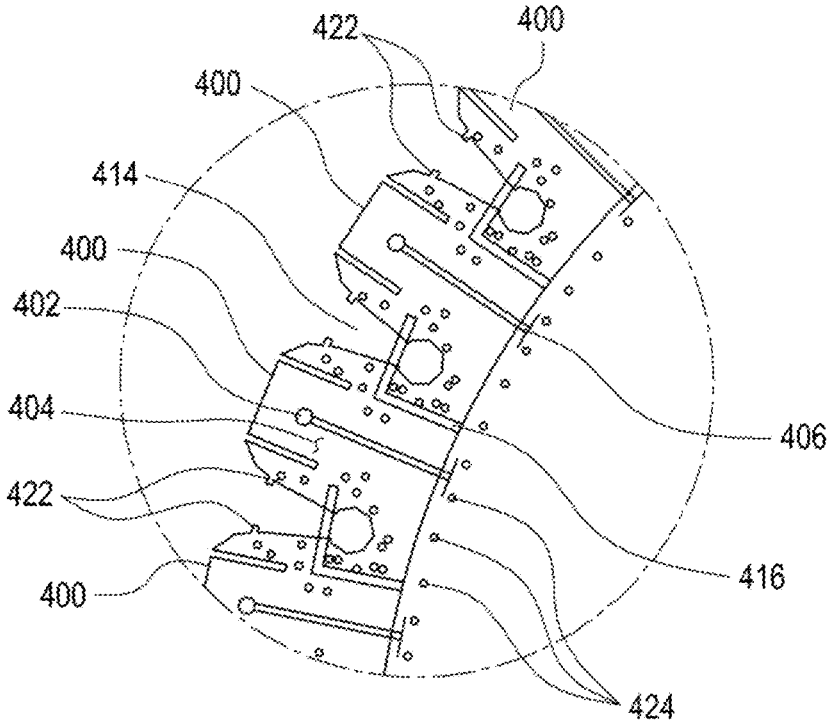
FIGS. 6A and 6B are enlarged views illustrating partial internal structures of a dual-type antenna element for polarization diversity beamforming according to an embodiment of the present disclosure
Figure 6B:
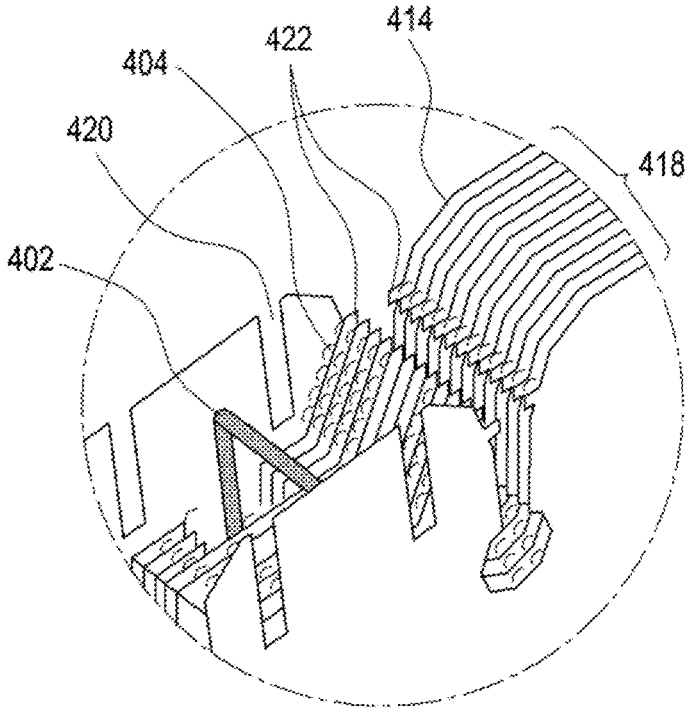

FIGS. 6A and 6B are enlarged views illustrating partial internal structures of a dual-type antenna element for polarization diversity beamforming according to an embodiment of the present disclosure.

Referring to FIG. 6A, a plurality of dual-type antenna elements 400 are mutually connected to expand laterally and may be arranged on multiple layers 418 (referring to FIG. 6B). For example, a plurality of aperture radiation-type structures 404 (marked in doted lines of FIG. 5A) of the dual-type antenna element 400 may couple in a horizontal direction, and a plurality of traveling radiation-type structures 414 may be formed as portions of the aperture radiation-type structures 404 and be coupled together in a horizontal direction of the electronic device 10 with respect to the tapered slots. The tapered slot-shaped second antenna 412 may provide a horizontal polarization radiation to maintain a low reflection loss on a wide frequency band.

Referring to FIG. 6B, the plurality of dual-type antenna elements 200 of the same shape may be structured to stack one over another on multiple layers. Dielectric layers may be arranged between the layers, and a choke 420 may be disposed on the uppermost layer or lowermost layer to isolate the elements for horizontal polarization radiation and vertical polarization radiation.

For example, the dual-type antenna element 400 may include the choke 420 to isolate the horizontal polarization radiation structure by the second antenna 412 from the vertical polarization radiation structure of the first antenna 402. Accordingly, a decoupling between the dual-type antenna elements 400 positioned adjacent to each other may be achieved by high-impedance chokes 420.

According to an embodiment of the present disclosure, the choke 420 may be 0.18λ and 0.024λ wide. The chokes 420 may be symmetrical with respect to the first antenna 402 and face each other.

According to an embodiment of the present disclosure, the traveling radiation-type structure 414 may include a balance-to-unbalance (balun) for impedance matching disposed at a side of the tapered slot. For example, the second power feeding port 416 may be shorted on a side surface of the second antenna 412 of a tapered slot shape, and the second power feeding port 416 may be disposed at an end of the impedance matching balun in an opened form.

According to an embodiment of the present disclosure, the traveling radiation-type structure 414 may further include a structure for matching with the antenna impedance for horizontal polarization radiation. For example, such structure may be formed by stubs 422. The stubs 422 in pair may protrude along a length direction of the tapered slot 412, spaced apart from each other. The stubs 422 may couple with an unbalanced circuit, such as a coaxial cable and circuit disposed parallel with the ground in the very-high-frequency-band transmission circuit, to induce impedance matching. The stubs 422 may match the second antenna 412 with the external space on a wide frequency band.

According to an embodiment of the present disclosure, the structures stacked vertically to the second antenna 412 in the PCB may mutually be electrically connected by conductive posts 424.

Figure 7:
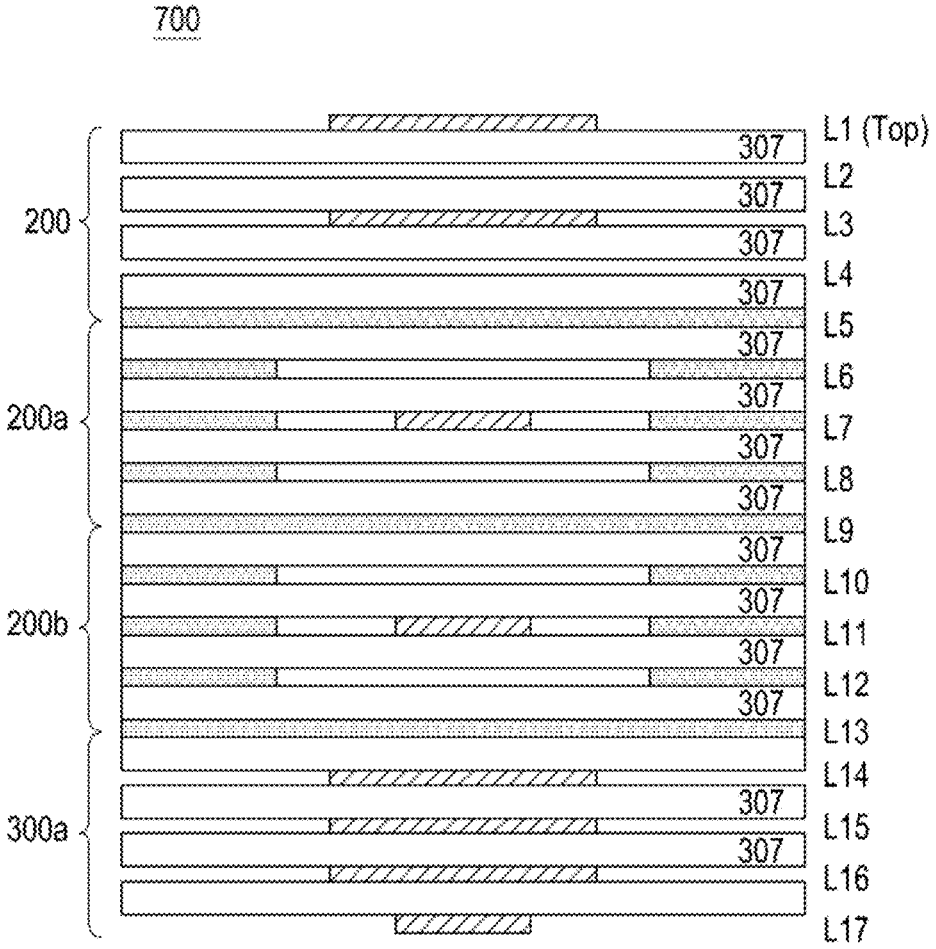
FIG. 7 is a cross-sectional view illustrating a stack structure of a millimeter wave (mmWave) monolithically integrated antenna module according to an embodiment of the present disclosure.

FIG. 7 is a cross-sectional view illustrating a stack structure of a mmWave monolithically integrated antenna module according to an embodiment of the present disclosure.

Examples of an mmWave monolithically integrated antenna module, such as the antenna module 20 of FIG. 2A, may be manufactured using monolithically stacking techniques using a PCB, LTCC, or any dielectric materials. For clarity, the following description focuses on an example of an antenna module 700, similar to the antenna module 20 of FIG. 2A, formed of a PCB, such as PCB 104 of FIG. 1. However, the present disclosure is not limited thereto, and similar structures may likewise be applicable to any other embodiments without departing from the present disclosure.

An example of a phase-controlled array of dual-type antenna elements 200 for integration in the electronic device 10, such as a mobile device, may be based on the mmWave monolithically integrated antenna module 700.

Referring to FIG. 7, the mmWave monolithically integrated antenna module 700 may include a stacked structure of dual-type antenna elements 200, feed lines 200*a* for vertical polarization antenna elements, feed lines 200*b* for horizontal polarization antenna elements, and feed lines 300*a* for power and communication lines for a corresponding RFIC.

According to an embodiment of the present disclosure, the stack-up of the mmWave monolithically integrated antenna module 700 may include a plurality of conductive layers, and a plurality of layers L1 to L5 from the top may be multiple conductive layers for a broad-side antenna array. Under the conductive layers for the antenna array may sequentially be arranged conductive lines L5 to L9 for end-fire horizontal polarization antenna feed lines, conductive lines L9 to L13 for vertical polarization antenna feed lines, and conductive lines L13 to L17 for RFIC data and power lines.

According to an embodiment of the present disclosure, the horizontal polarization antenna feed lines 200*b* and the vertical polarization antenna feed lines 200*a* may include a strip line type. For example, two adjacent ones of the horizontal polarization antenna feed lines 200*b* or two adjacent ones of the vertical polarization antenna feed lines 200*a* may be separated by a dielectric layer 307. The conductor trace width and substrate height may be determined depending on how many layers are stacked while providing a minimum feed line loss.

According to an embodiment of the present disclosure, the dual-polarization array may be achieved by the structure of dual-type antenna elements and the stacked arrangement of the feed lines so as to include dual-type antenna elements allocated with a high density.

Figure 8:
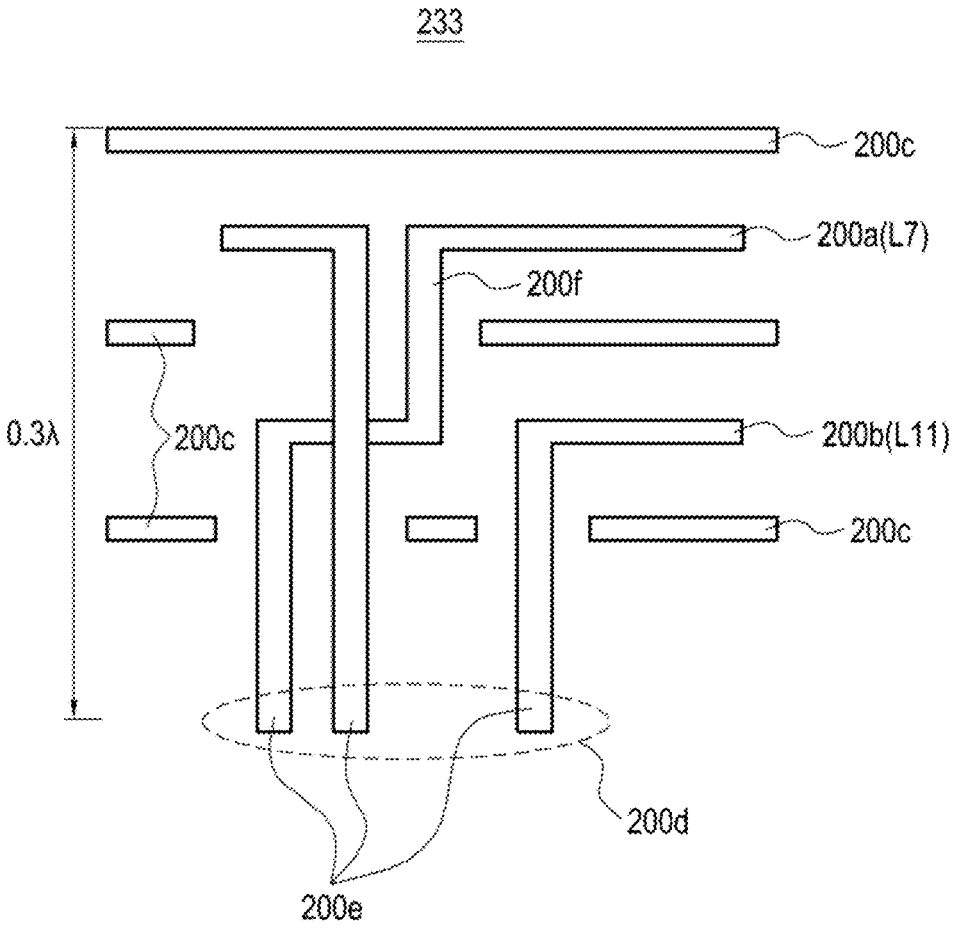
FIGS. 8 and 9 are views illustrating stack structures of some of the dual-type antenna elements of FIGS. 3A, 3B, and 3C according to an embodiment of the present disclosure.
Figure 9:
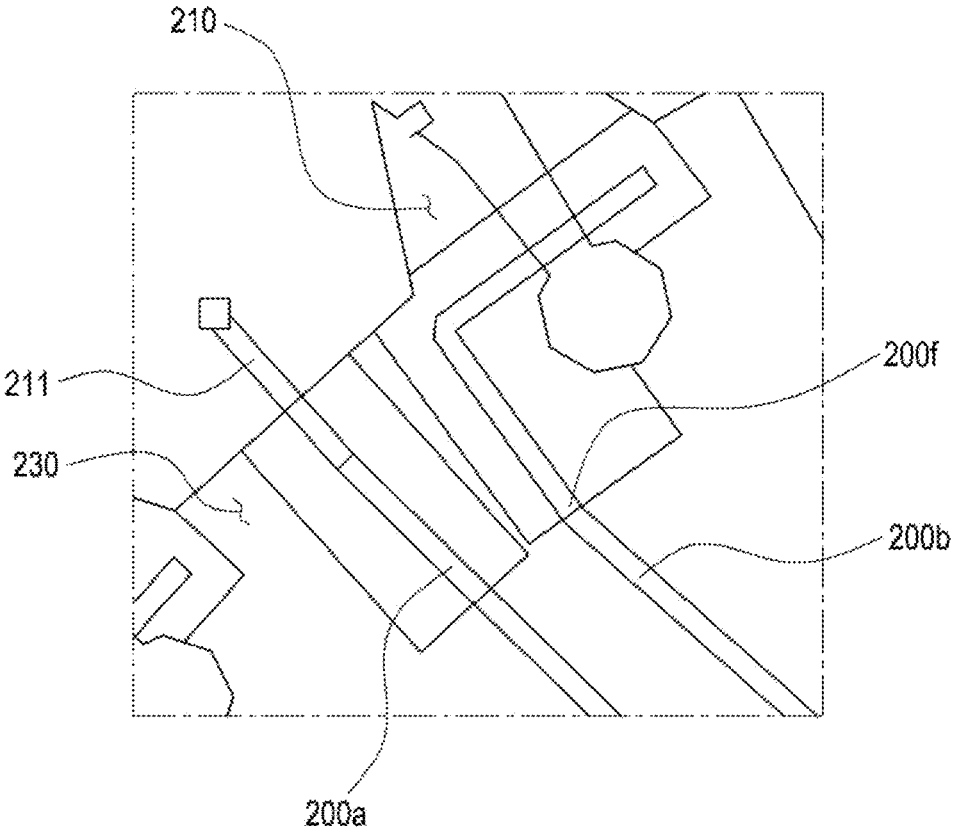

FIGS. 8 and 9 are views illustrating stack structures of some of the dual-type antenna elements of FIGS. 3A, 3B, and 3C according to an embodiment of the present disclosure.

Referring to FIGS. 8 and 9, some feed lines 200*a* of the vertical polarization antenna elements generating a vertical polarization radiation may be arranged on layer 11 (L11) (refer to FIG. 7) of the mmWave monolithically integrated antenna module 700, and some feed lines 200*b* of the horizontal polarization antenna elements generating a horizontal polarization radiation may be arranged on layer 7 (L7) (refer to FIG. 7) of the mmWave monolithically integrated antenna module 700. Thereunder may be disposed one of the conductive layers for the stacked feed lines 300*a* for RFIC data and power lines.

According to an embodiment of the present disclosure, the conductive layers may be arranged along a direction stacked, and insulating layer 307 formed of a dielectric may be disposed on a rear or front surface of each conductive layer. The layers may be alternately and repeatedly arranged one over another. The conductive layers may have at least one conductive via 200*e* for an electrical connection.

According to an embodiment of the present disclosure, the insulating layer 307 may be provided between the conductive layers to prevent the conductive layers from contacting each other to make an electrical connection. For example, the plurality of insulating layers each provided between two adjacent ones of the plurality of conductive layers may insulate the conductive layers from each other. The insulating layers may include a resin and glass fabric.

According to an embodiment of the present disclosure, the conductive layers may be electrically connected with any one of a plurality of signal lines and a plurality of ground lines 200*c*. Conductive vias 200*e* connecting the conductive layers with each other may include conductive vias conducting through all of the layers and conductive vias conducting between layers positioned adjacent to each other.

According to an embodiment of the present disclosure, some of the conductive layers 300*a* for feed lines for RFIC data and power lines, which are stacked at a lower portion, may include a contact layer 200*d*. The feed lines may transmit electrical signals from the contact layer 200*d* through the above-mentioned conductive via 200*c* to each signal layer. For example, the signal layers may form strip lines (first power feeding port 213) feeding power to the first antenna 211 of the aperture radiation-type structure 210 shaped as a horn antenna. As another example, the signal layers may form a slot-coupler line (second power feeding port 214) feeding power to the second antenna 231 of the traveling radiation-type structure 230. Adjacent signal layers may be isolated by a ground layer 200*c*.

According to an embodiment of the present disclosure, excitation of a polarization mode of the dual-type antenna elements 200 in two separate polarization modes may be provided by the feed lines of vertical polarization antenna elements and the feed lines of the horizontal polarization antenna elements. For example, some feed lines for the horizontal polarization antenna elements may be allocated to layer 11 (L11) of the dual-type antenna elements 200, and signals may be transmitted to the antenna element layer through the via 200*f* disposed on layer 7 to layer 11 (L7-L11).

FIGS. 10A, 10B, 10C, and 11 are views illustrating layouts of an antenna array module including a RFIC according to an embodiment of the present disclosure.

Figure 10A:
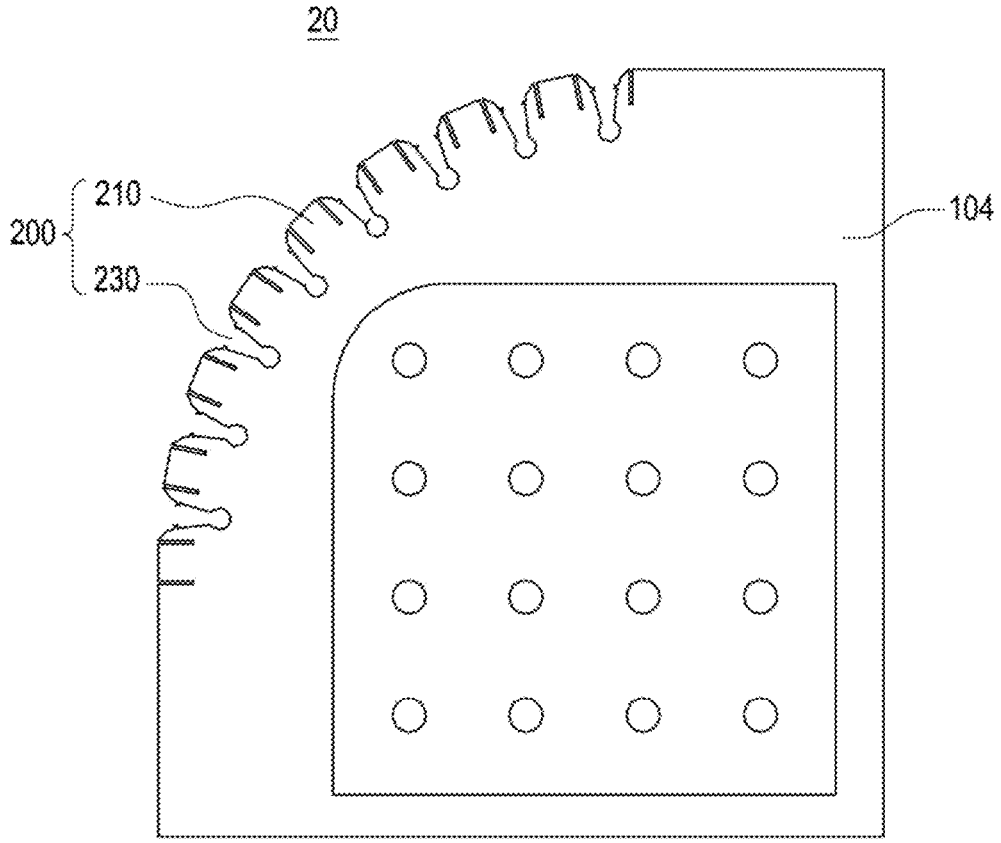
FIGS. 10A, 10B, and 10C are views illustrating layouts of an antenna array module including a radio frequency integrated circuit (RFIC) according to an embodiment of the present disclosure.
Figure 10B:
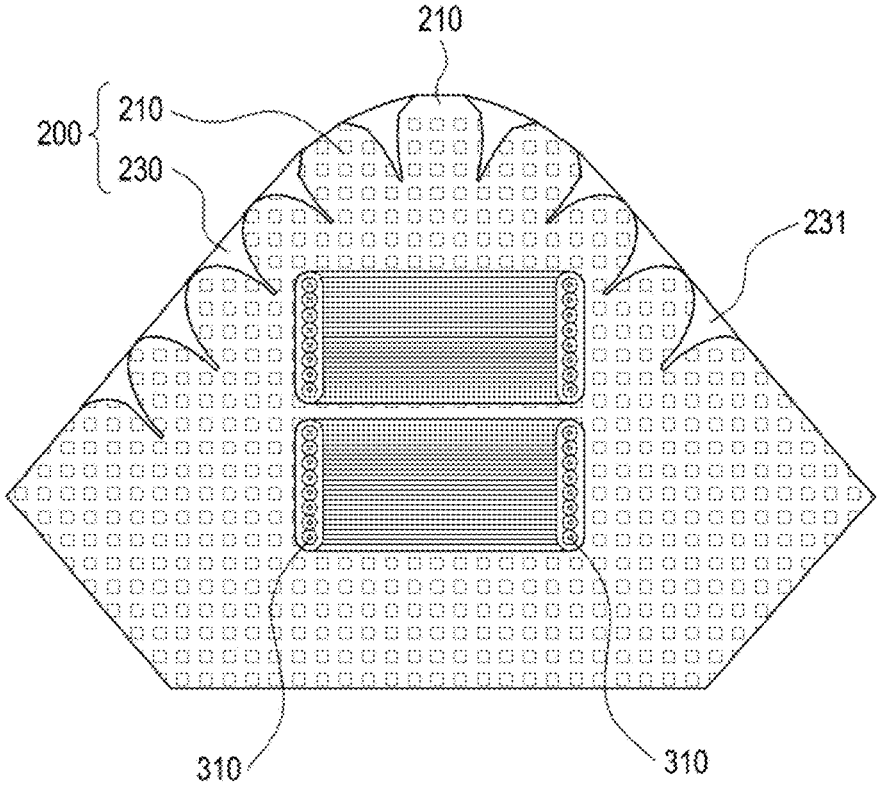

Referring to FIGS. 10A and 10B, the mmWave monolithically integrated antenna module 20 may be disposed near a corner of the electronic device 10. For example, structures (aperture radiation-type structure 210 and traveling radiation-type structure 230) of a dual-type antenna element 200 are shown, which extend along an arc of a fan shape near an upper and left portion.

According to an embodiment of the present disclosure, the dual-type antenna elements 200 of the antenna module 20 may be formed of a waveguide(s) arranged on at least one surface of the circuit board 104. When the circuit board 104 is a multi-layered circuit board, there may be included a grid structure including a combination of a via hole and/or conductive pattern formed in the multi-layered circuit board or a portion of the waveguide pipe formed on at least one layer of the circuit board 104.

According to an embodiment of the present disclosure, the antenna module 20, when viewed from above, may include multiple slots forming the traveling radiation-type structure 230. The traveling radiation-type structure 230 may be provided by slot lines provided on a surface in a lengthwise direction of the waveguide-shaped aperture radiation-type structure 210.

Figure 10C:
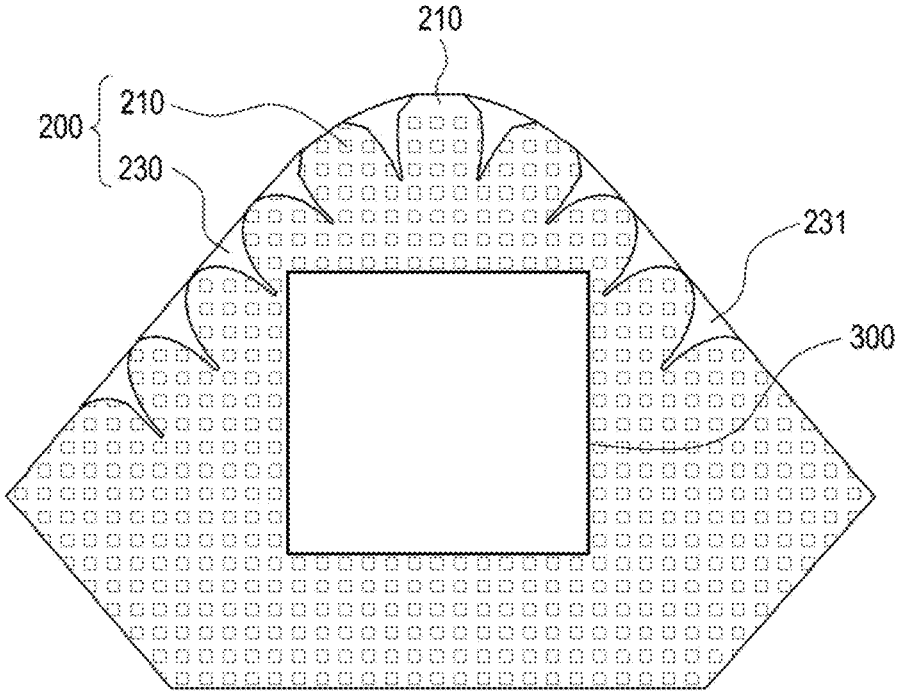

Referring to FIG. 10C, the antenna module 20 may have a RFIC 300 disposed therein at the center thereof. The RFIC 300 may be positioned near the dual-type antenna elements 200 and electrically connected with the dual-type antenna elements 200. The area occupied by the RFIC 300 and the antenna array may be $2.4\lambda \times 3\lambda$.

Figure 11A:
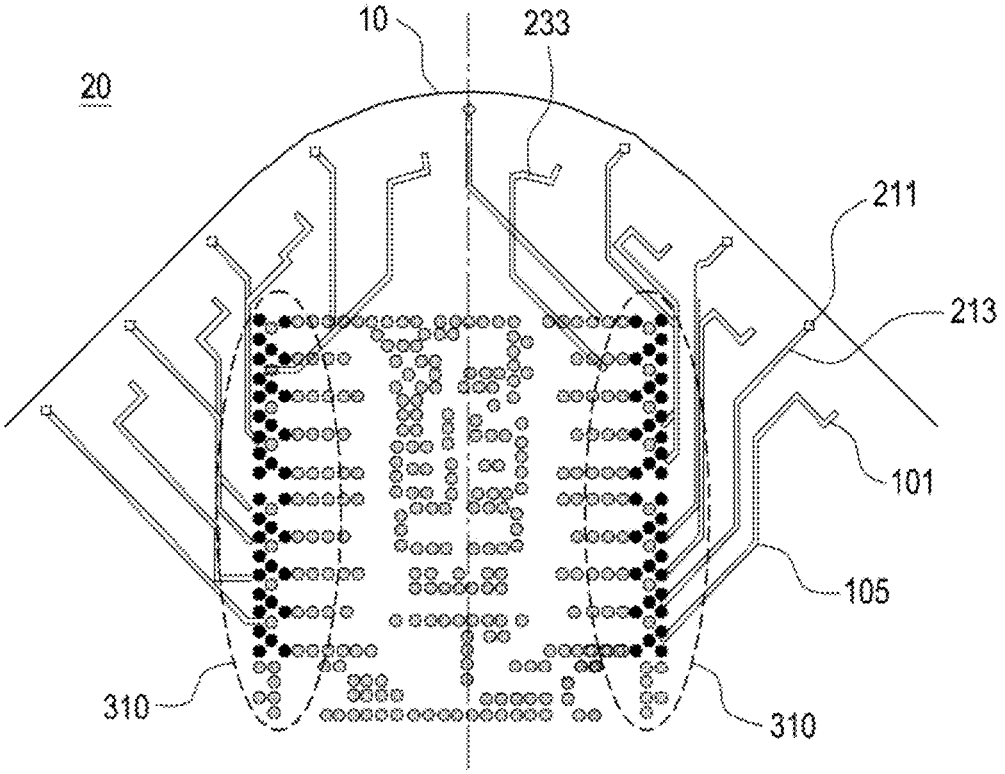
FIGS. 11A and 11B are views illustrating layouts of an antenna array module electrically connected with a RFIC according to an embodiment of the present disclosure.
Figure 11B:
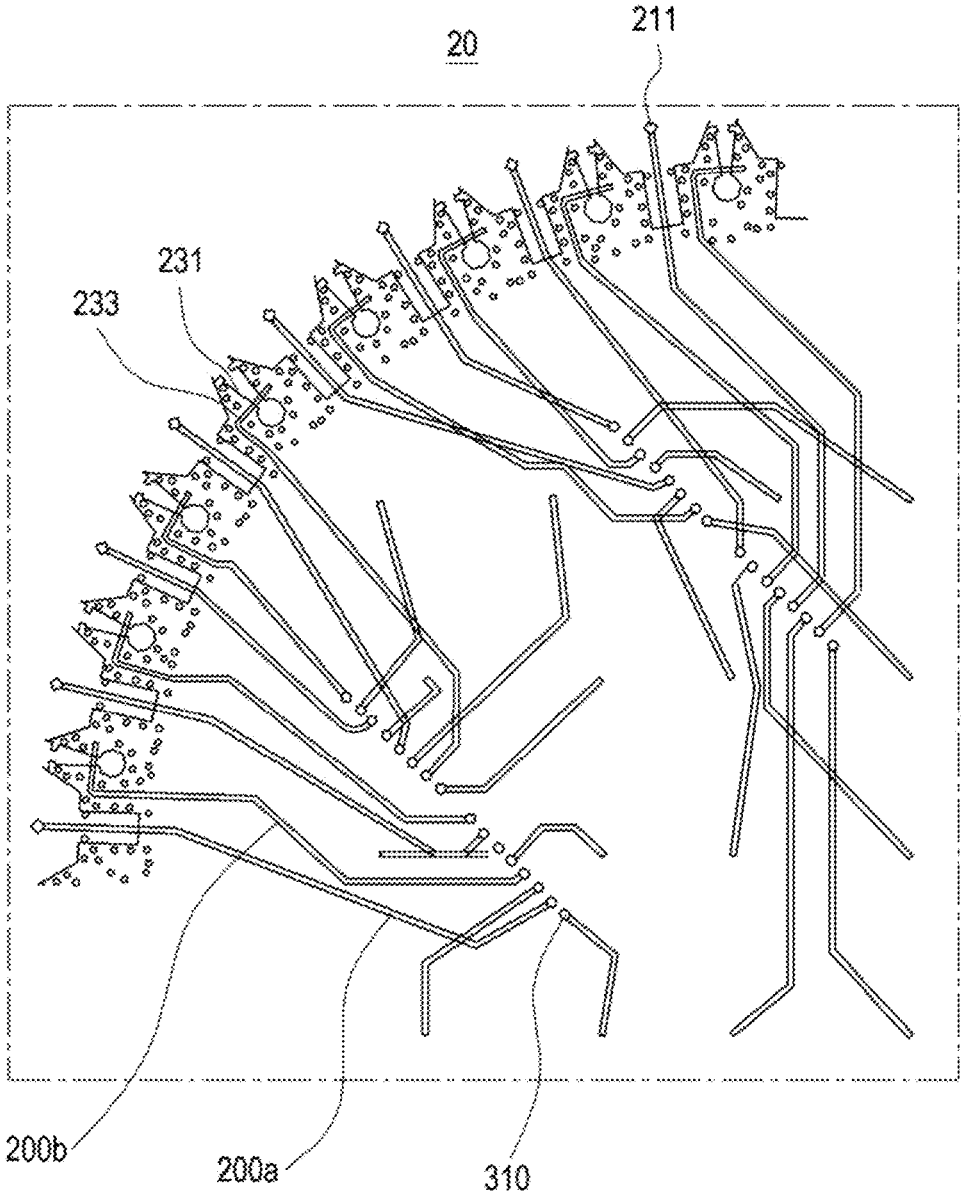

Referring to FIGS. 11A and 11B, strip lines in charge of electrical connection may be organically arranged in the mmWave monolithically integrated antenna module.

According to an embodiment of the present disclosure, first power feeding ports 211 shaped as feed strip lines and second power feeding ports 233 shaped as slot-coupler strip lines may feed power from outputs 310 of the RFIC 300 to a horn antenna-shaped first antenna 211 and a tapered slot-shaped second antenna 231 (refer to FIGS. 10A, 10B, and 10C). The first antenna 211 and the second antenna 231 electrically connected with each other may generate a vertical polarization radiation and horizontal polarization radiation, respectively. Such structures all may be formed in the mmWave monolithically integrated antenna module 20.

According to an embodiment of the present disclosure, the RFIC 300 and strip lines may be disposed adjacent to each other. For example, upon feeding power from the output 310 of the RFIC 300 to the second antenna 231, a feed line loss in the slot-coupler strip line needs to be minimized. Further, upon feeding power from the output 310 of the RFIC 300 to the first antenna 211, a feed line loss in the strip line needs to be minimized. Thus, the RFIC 300 may be disposed within a minimum distance from the first antenna 211 and/or the second antenna 231 (FIG. 6C) to reduce such feed line loss.

According to an embodiment of the present disclosure, each structure according to the mmWave monolithically integrated antenna module 20 may provide maximized overall radiation power with a minimized power loss in the feed lines and junctions. All of the components in the mmWave monolithically integrated antenna module 20 are manufactured in a common monolithic module process sequence. Thus, allowable tolerances and yields in production may be maximized.

Figure 12A:
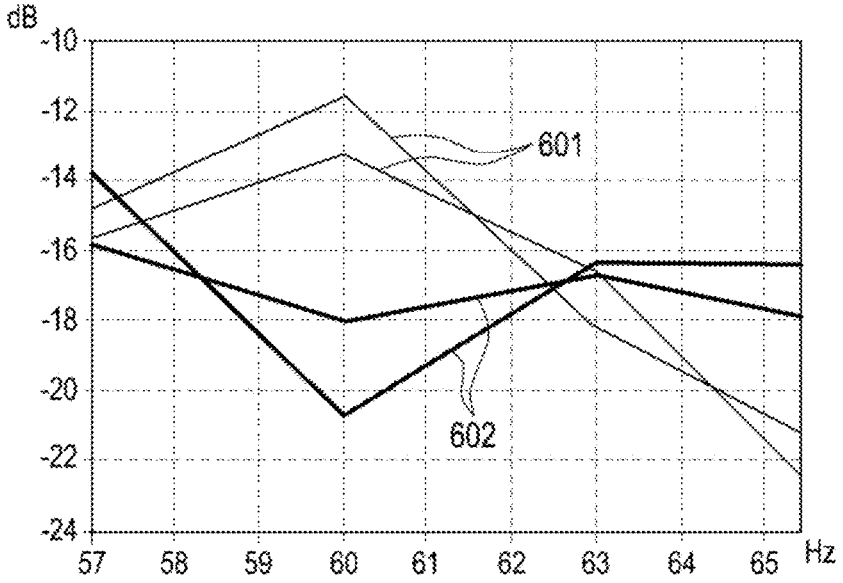
FIGS. 12A and 12B are graphs illustrating examples of impedance matching and isolation of radiation-type structures of an antenna array module according to an embodiment of the present disclosure
Figure 12B:
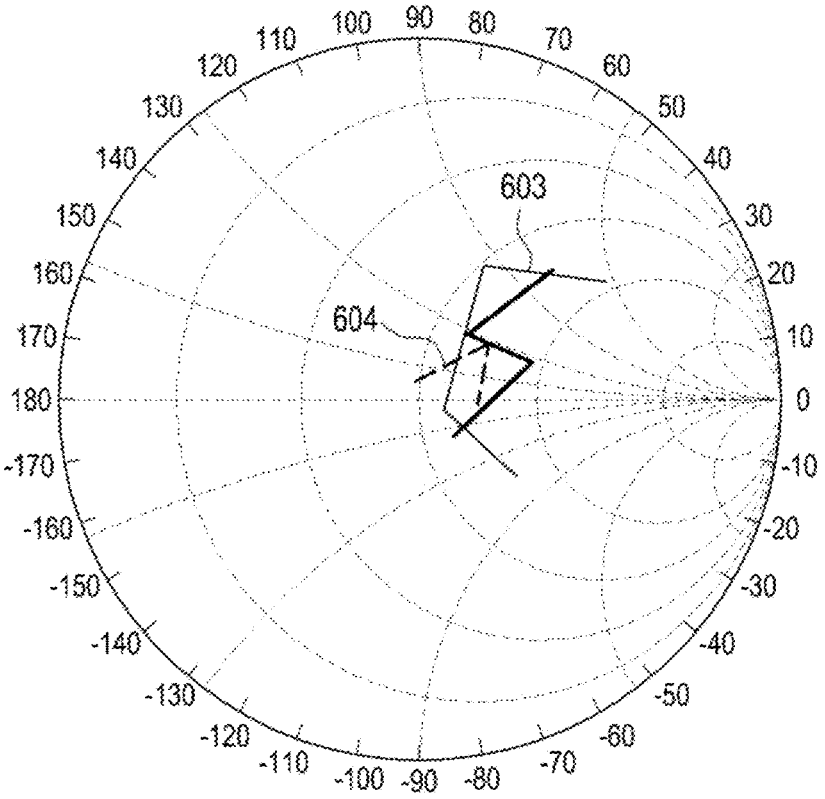

FIGS. 12A and 12B are graphs illustrating examples of impedance matching and isolation of radiation-type structures of an antenna array module according to an embodiment of the present disclosure.

Referring to FIG. 12A, the upper two lines 601 show the relation between adjacent co-polar elements, and the lower two lines 602 show the relation between adjacent cross-polar elements.

According to an embodiment of the present disclosure, it is verified that the coupling 601 between adjacent cross-polar elements radiating a vertical polarization by an aperture radiation-type structure represents a small value, about −20 dB at 60.00 GHz on the vertical axis. It is verified that the value is small enough to be able to disregard the cross-polar coupling 602 and does not influence beamforming of the antenna array.

According to an embodiment of the present disclosure, it is verified that the coupling 602 between adjacent co-polar elements radiating a horizontal polarization by a traveling radiation-type structure represents a small value, about −12 dB at 60.00 GHz on the vertical axis. It is verified that, although the antenna exhibits a relatively larger coupling value than that of the co-polar elements because it has the same polarization, it is still at a very low level enough to neglect the co-polar coupling 602 without affecting beamforming of the antenna array.

FIG. 12B illustrates an example of impedance matching for a horizontal polarization 603 according to an impedance matching and traveling radiation-type structure for a vertical polarization 604 of an aperture radiation-type structure.

The graph is an impedance chart showing 50 ohm matching on a Smith chart, and where is marked as Center 1.0 is a 50 ohm region. Each value is one obtained by normalizing a complex value denoted with =R+jX.

Since it may be analyzed that good impedance matching is achieved as the lines on the graph approach 1.0, it can be verified that, according to the present disclosure, antenna cross-polar coupling may be disregarded, not influencing beamforming of the antenna array. According to the present disclosure, the impedance matching may lead to maximized power transmission and minimized parasitic signal reflections.

Now described are various shapes of a leaky wave structure.

Figure 13:
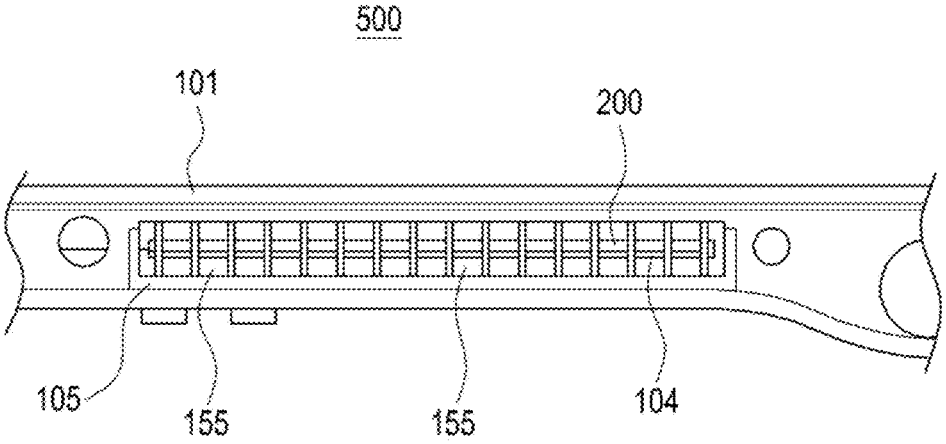
FIGS. 13, 14, and 15 are views illustrating various forms of leaky wave structures in an antenna device of a wireless communication device and/or electronic device according to an embodiment of the present disclosure.
Figure 14:
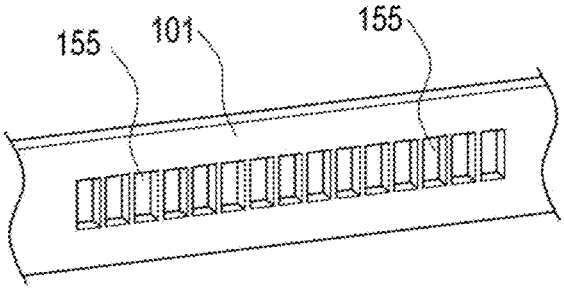
Figure 15:
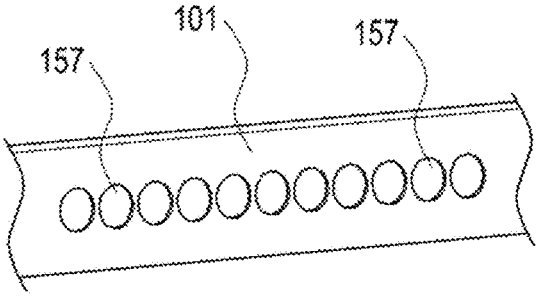

FIGS. 13, 14, and 15 are views illustrating various forms of leaky wave structures in an antenna module of a wireless communication device and/or electronic device 10 according to an embodiment of the present disclosure.

In the embodiment described above in connection with FIG. 1, an example is described in which an opening is formed over two side surfaces of the housing 100. In the instant embodiment, however, described is a leaky wave structure 500 in which an opening is formed in a single side surface of the housing 100 (e.g., the metal frame 101), for example.

Referring to FIGS. 1 and 13, a portion of the metal frame 101 in the electronic device (e.g., the electronic device 10 of FIG. 1) may be provided as a leaky wave surface (e.g., a partial reflection surface). For example, the metal frame 101 may have a plurality of openings 155 (e.g., a waveguide) filled with a dielectric substance, and the conductive structure (or conductive pattern) between the neighboring openings 155 may function as the leaky wave surface. The circuit board 104 including the dual-type antenna elements 200 may be received inside the metal frame 101. The dual-type antenna elements 200 may be arranged adjacent to the opening 155 inside the metal frame 101.

Referring to FIGS. 14 and 15, according to an embodiment of the present disclosure, the beam deflector (e.g., the beam deflector 105 of FIG. 1) of the electronic device 10 may include a conductive structure, e.g., the metal frame 101, and a plurality of openings 155 and 157 formed in the metal frame 101. The array of the openings 155 and 157 and a portion of the metal frame 101 may be electromagnetically combined with a dual-type antenna element array (e.g., the array 201 of FIG. 1) through the cavity formed inside the metal frame 101 and may convert a surface current into a leaky wave and radiate the leaky wave to the free space. In some embodiment, the openings 155 and 157 may have a polygonal or circular shape and may be partially filled with a dielectric substance. According to an embodiment of the present disclosure, when the electronic device has a sound input or output function, at least some of the openings 155 and 157 may be utilized as an acoustic hole through which sound is propagated.

Figure 16A:
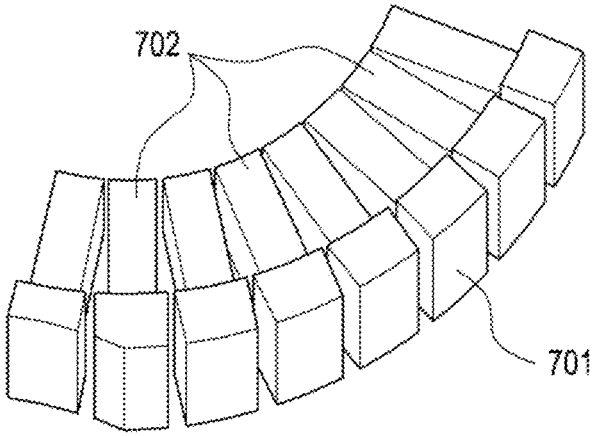
FIGS. 16A and 16B are views illustrating antenna arrays free of a metal frame or plastic casing according to an embodiment of the present disclosure.
Figure 16B:
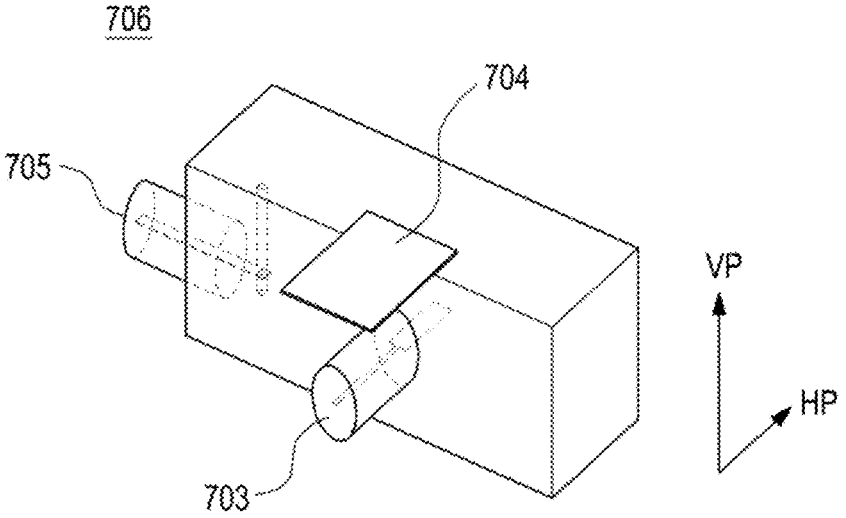

FIGS. 16A and 16B are views illustrating antenna arrays free of a metal frame or plastic casing according to an embodiment of the present disclosure.

Referring to FIG. 16A, the antenna module 20 (e.g., the antenna module 20 of FIG. 7) may include a dielectric-filled waveguide 701 and feed dual-polarization ports 702. The dual-polarization ports 702 may be connected with a polarizer 706. The feed dual-polarization ports 702 may be implemented by a monolithically integrating technique.

Referring to FIG. 16B, the polarizer 706 may include a polarization filter 704 changing the direction of electromagnetic waves passing through the electronic device. Accordingly, a vertically polarized electromagnetic wave and/or horizontally polarized electromagnetic wave may be independently radiated through the polarization filter 704 of the polarizer 706. The vertically polarized electromagnetic wave may be excited by a wave port 705, and the horizontally polarized electromagnetic wave may be excited by a wave port 703.

Figure 17A:
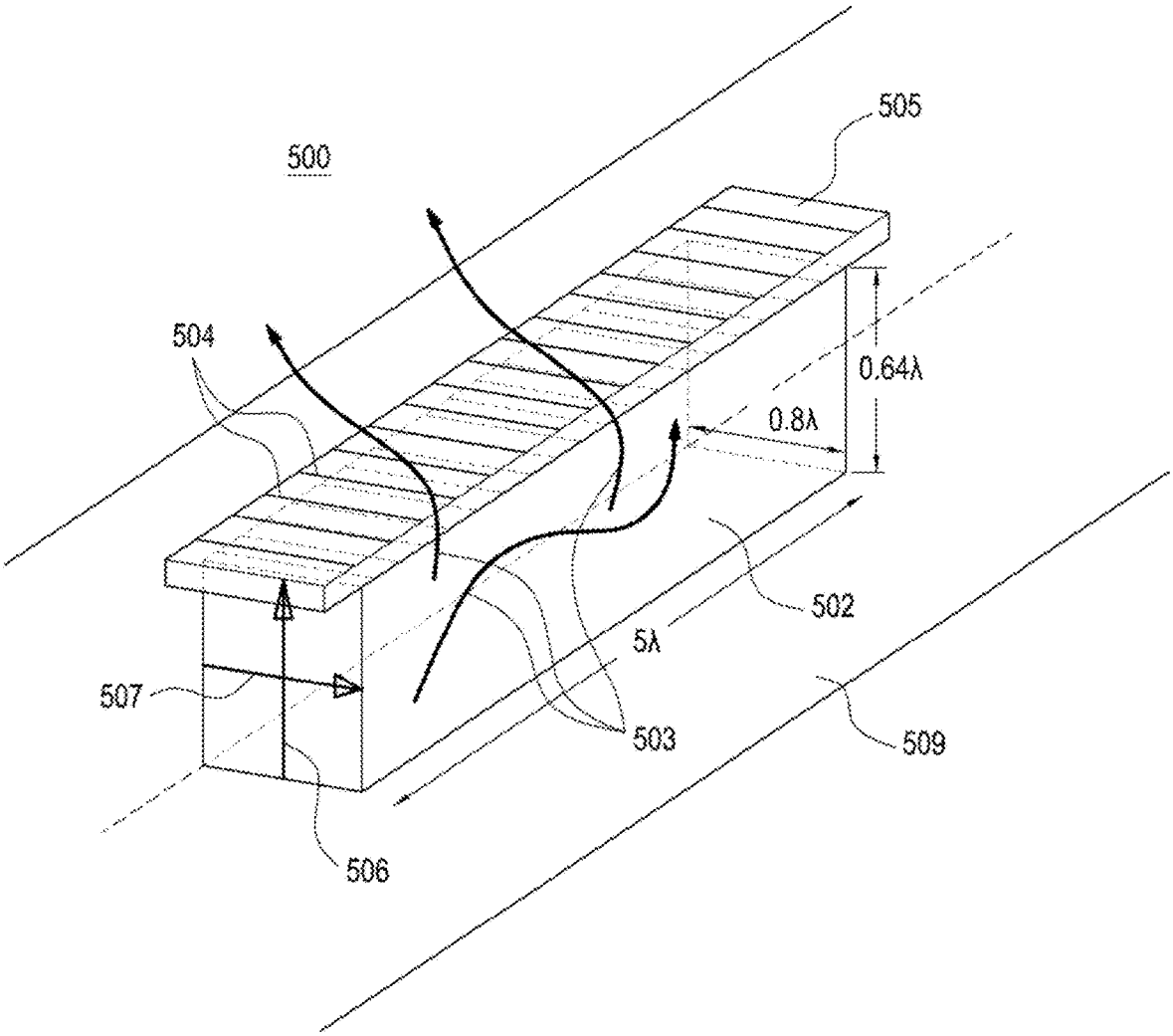
FIGS. 17A and 17B are perspective views illustrating metal-frame dual-polarization-type leaky wave structures according to an embodiment of the present disclosure.
Figure 17B:
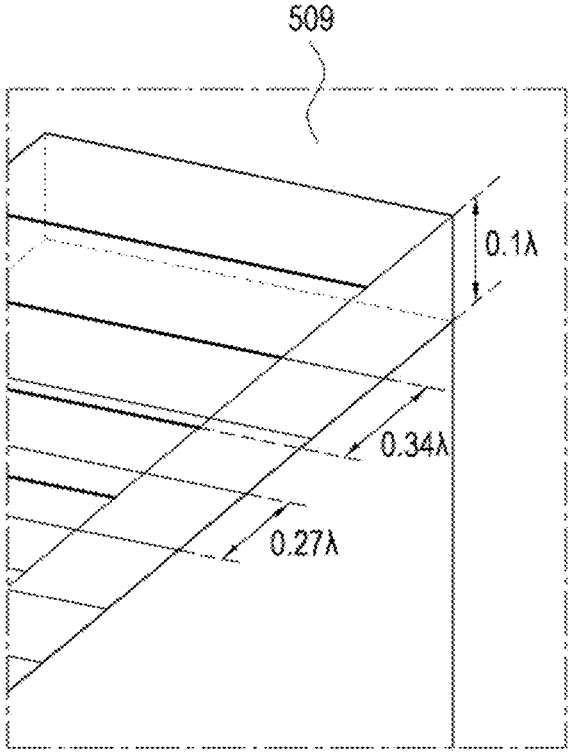

FIGS. 17A and 17B are perspective views illustrating a dual-polarization-type leaky wave structure of a metal frame according to an embodiment of the present disclosure.

In the embodiment described above in connection with FIG. 1, an example is described in which an opening is formed over two side surfaces of the housing 100. In the instant embodiment, however, described is a leaky wave structure 500 in which an opening is formed in a single side surface of the housing 100 (e.g., the metal frame 101), for example.

Referring to FIGS. 1 and 17A, the dual-polarization-type leaky wave structure 500 may be disposed on one surface of the housing 100, e.g., on the metal frame 509. The metal frame 509 may include an opening 511 formed in one straight line section, a leaky waveguide 502 disposed inside the opening 511, and a beam deflector 505 (e.g., the beam deflector 105) disposed at a side of the leaky waveguide 502.

According to an embodiment of the present disclosure, the beam deflector 505 may be formed by a dielectric cover having conductive patterns 504. According to an embodiment of the present disclosure, the conductive patterns 504 may be formed based on molded metal stripes. However, the present disclosure is not limited thereto. Other embodiments may include laser-etched metal patterns or metal disposition or its relevant techniques.

According to an embodiment of the present disclosure, the leaky wave structure 500 may have a size of $0.64\lambda \times 0.8\lambda \times 5\lambda$ (where 'λ' is the wavelength of a resonant frequency formed in the leaky wave structure), and the beam deflector 505 may be inserted from outside of the metal frame 509 into the opening to close the opening.

A look at the structure of the enlarged beam deflector 505 of FIG. 17B reveals that the conductive patterns (metal stripes) 504 include two layers respectively being 0.34λ wide and 0.27λ wide. The conductive patterns 504 may be sized or dimensioned to be $0.02\lambda \times 0.8\lambda$, and the beam deflector 505 may be substantially 0.1λ thick.

According to an embodiment of the present disclosure, in the above leaky wave structure 500, an electromagnetic wave may propagate along the length direction of the opening 111 or may be radiated to the free space through the beam deflector 105. The radiation direction (or angle) of the electromagnetic wave and/or wireless signal radiated to the free space may be varied depending on the phase distribution of the above-described array of antenna elements or the propagation constant of the leaky wave structure.

For example, two modes of electromagnetic waves may be radiated through a leaky waveguide according to the leaky wave structure 500. The two modes of electromagnetic waves may include a vertical polarization radiation by the vertical polarization mode 506 and a horizontal polarization radiation by the horizontal polarization mode 507, and the electromagnetic waves may propagate into an outer space through the beam deflector 105 or travel through the leaky waveguide 502.

According to an embodiment of the present disclosure, a beam may be formed in a previously specified direction by the device, and the wireless communication device may operate in at least one beamforming mode of an array mode by an array of the antenna elements, a leaky wave mode by the leaky wave radiator, and a mixed mode by a combination of the array mode and the leaky wave mode.

Figure 18A:
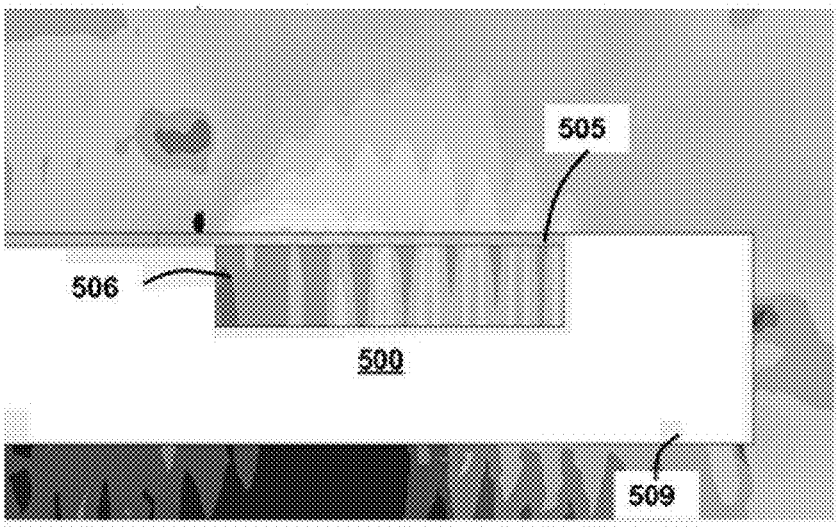
FIGS. 18A and 18B are views illustrating distributions of electromagnetic waves radiated through leaky wave structures according to an embodiment of the present disclosure.
Figure 18B:
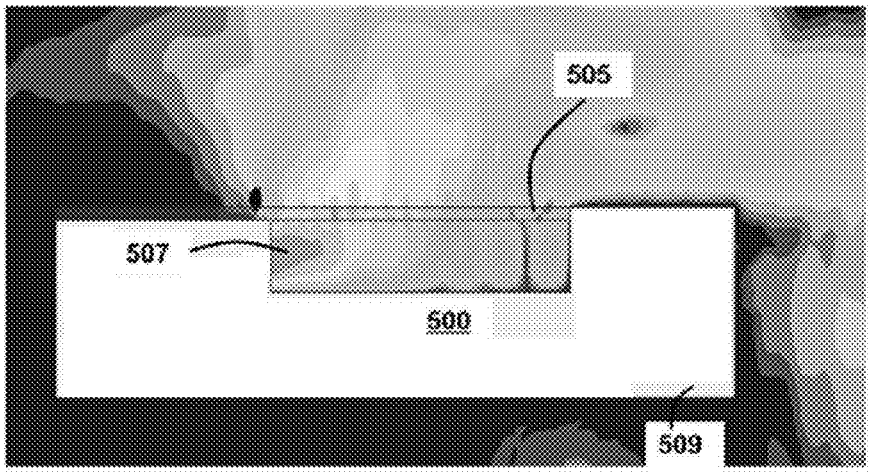

FIGS. 18A and 18B illustrates a distribution of electromagnetic waves propagating through leaky wave structures.

Referring to FIG. 18A, when a vertical polarization mode 506 according to the aperture radiation-type structure (e.g., the aperture radiation-type structure 210 of FIGS. 2A, 2B, and 2C) runs, the capability of the leaky wave structure 500 may be verified. Referring to FIG. 18B, when a horizontal polarization mode 507 according to a traveling radiation-type structure (e.g., the traveling radiation-type structure 230 of FIGS. 2A, 2B, and 2C) runs, the capability of the leaky wave structure 500 may be verified.

Figure 19:
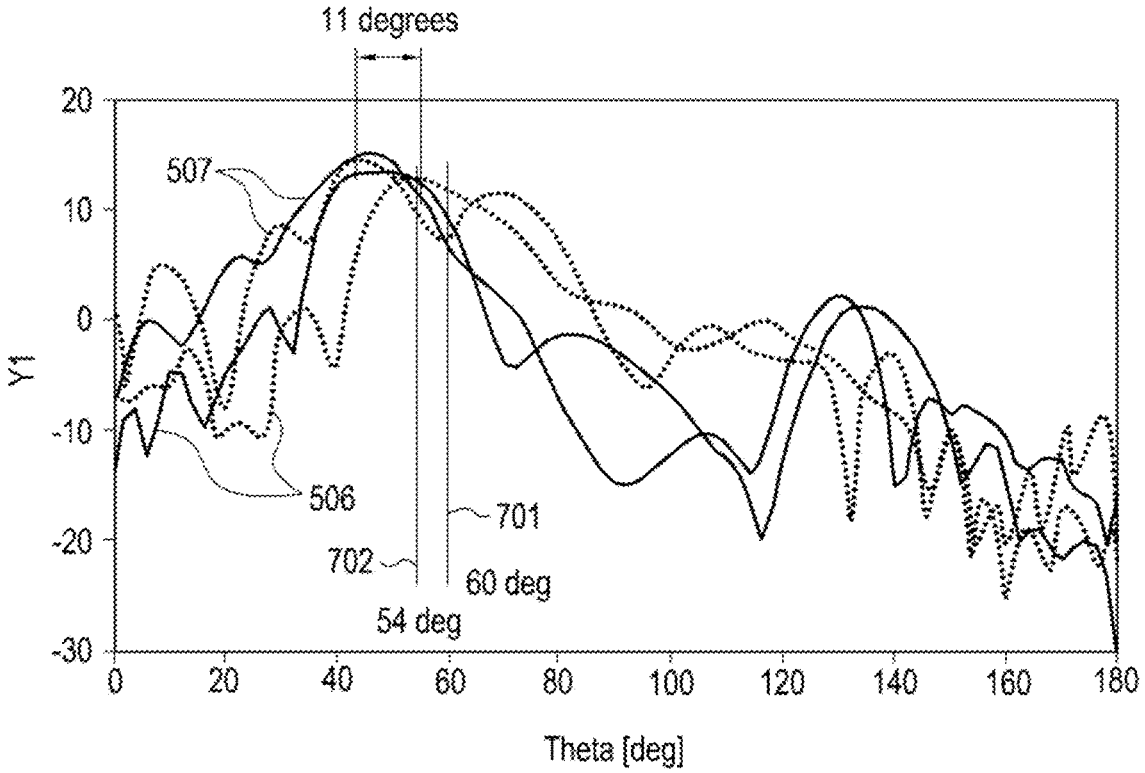
FIG. 19 is a view illustrating radiation patterns in a vertical polarization mode and horizontal polarization mode as propagated through leaky wave structures according to an embodiment of the present disclosure.

FIG. 19 is a view illustrating radiation patterns in a vertical polarization mode 506 and horizontal polarization mode as propagated through a leaky wave structure according to an embodiment of the present disclosure.

Referring to FIG. 19, it may be verified that the vertical polarization mode 506 provides beamforming at 105 degrees (701) relative to a symmetry line Y1 on the azimuth plane. The beam squint is ±5 degrees on an operating frequency band.

It may also be verified that the horizontal polarization mode 507 provides beamforming at 100 degrees (702) relative to a symmetry line Y1 on the azimuth plane. It can be verified that the beam squint is the same as ±5 degrees in the vertical polarization mode on the operating frequency band. Such method may prevent beam squinting for beam tilt angles which are extreme values while reducing losses to beam scanning.

The leaky-wave phased array antenna may be used for devices such as a mobile phone, tablet, wearables, as well as stationary devices: base-stations, routers, and other kinds of transmitters. An antenna array may be embedded into the mobile device for providing multi-gigabit communication services such as high definition television (HDTV) and ultra-high definition video (UHDV), data files sharing, movie upload/download, cloud services and other scenarios.

According to an embodiment of the present disclosure, methods for enhancing network functionality enabled by the leaky wave phase array antenna and/or electronic device may include concurrent transmission (spatial reuse), multiple-input and multiple-output (MIMO) technique and the full-duplex technique.

According to an embodiment of the present disclosure, mmWave communication standards enabled by the leaky wave phase array antenna and/or electronic device may include wireless personal area networks (WPAN) or WLAN, for example, European Computer Manufacturers Association (ECMA-387), Institute of Electrical and Electronics Engineers (IEEE) 802.15.3c, and IEEE 802.11ad.

In an embodiment, the physical layer and media access control (MAC) layer may support multi-gigabit wireless applications including instant wireless sync, wireless display of HD streams, cordless computing, and internet access. In the physical layer, two operating modes may be defined, the orthogonal frequency division multiplexing (OFDM) mode for high performance applications (e.g. high data rate), and the single carrier mode for low power and low complexity implementation.

The designated device may provide the basic timing for the basic service set and coordinate medium access to accommodate traffic requests from the mobile devices. The channel access time may be divided into a sequence of beacon intervals (BIs), and each BI may include beacon transmission interval, association beamforming training, announcement transmission interval, and data transfer interval. In beacon transmission interval, the base station may transmit one or more mmWave beacon frames in a transmit sector sweep manner. Then initial beamforming training between the designated device and mobile devices, and association may be performed in association beamforming training. Contention-based access periods and service periods may be allocated within each data transfer interval by access point (AP) during announcement transmission interval. During data transfer interval, peer-to-peer communications between any pair of the mobile devices including the designated device and the mobile devices may be supported after completing the beamforming training. In IEEE 802.11ad, carrier sense multiple access with collision avoidance (CSMA/CA) and time division multiple access (TDMA) hybrid multiple access may be adopted for transmission between devices. CSMA/CA may be more suitable for bursty traffic such as web browsing to reduce latency, while TDMA may be more suitable for traffic such as video transmission to support better quality of service (QoS).

According to an embodiment of the present disclosure, antennas (e.g., antenna elements) may be arranged at, at least, one corner of the mobile device as shown in FIGS. 2A, 2B, and 2C.

Achievable scan range and antenna gain may be equal or better than standalone antenna module without the mobile device. Parasitic effects due to, e.g., surface current, in the case of the devices may be suppressed or eliminated.

The proposed leaky wave array antenna has the following advantages.

- Beamforming distortions due to metal or dielectric device structures are eliminated. Thus, antenna gain increases.
- Phase-controlled beam squint-free beamforming is achievable over 16% fractional bandwidth of the array. Beam scan range better than +/−70 degrees may be secured for the horizontal and/or vertical deflections.
- The array of eight antenna elements provides stable end-fire radiation beams with a realized gain over 10 dBi over the entire operating band.
- The mmWave antenna array is structurally simple and conductor-backed, which is potentially useful for conformal integration into the mobile device with the metal frame.
- mmWave antenna is designed with possibility of integration into the mobile phone with a metal frame.
- Antennas may be isolated or separated from environmental factors and mechanical impacts.
- mmWave antenna may satisfy mechanical tolerance and stress robustness requirements of the housing 100 and/or electronic device while providing a stable performance.
- Structures forming a leaky wave phase array antenna may provide high-gain, small-sized antenna modules.
- Separately operating leaky wave structure being coupled with the antenna module may increase beamscanning range and enhance antenna gain for highly deflected beams.
- the metal frame including beam deflectors may expand the beamscanning range.

As an example, and not as limitation, the leaky wave phase array antenna according to an embodiment of the present disclosure may be used as part of an antenna array embedded into the electronic device for transmitting high-volume data, such as an unpacked HD video stream. For example, the user may watch a desired movie through a TV set or monitor by simply turning on the TV set or monitor and activate streaming on the user's electronic device. Furthermore, sharing an HD movie between users, mere activation of the data transmission function of the electronic device enables transmission of the entire movie to the opposite party's mobile device supporting such standard within two or three seconds. Furthermore, upon downloading the last movie from a kiosk, simple payment for the movie through mobile pay allows for activation of data transmission and reception of the movie in two or three seconds. Furthermore, simply payment in an ebook store or some digital information sharing system allows for reception of an ordered item within two or three seconds. Furthermore, according to an embodiment of the present disclosure, the leaky wave phase array antenna and/or electronic device including the same may be used in other various scenarios requiring transmission of high-volume data.

As set forth supra, according to an embodiment of the present disclosure, in a wireless communication device and/or electronic device including an antenna device (e.g., a polarization-agile phased-array antenna), a mmWave antenna module comprises a plurality of antenna elements, an RFIC, and a power feeding line, wherein the plurality of antenna elements are dual-type antenna elements configured to excite different polarization modes, and wherein the power feeding line allows a plurality of ports of the RFIC to individually connect to the plurality of dual-type antenna elements to excite the different polarization modes to perform beamforming.

According to an embodiment of the present disclosure, the dual-type antenna elements may be configured by an aperture radiation-type structure providing a vertical polarization radiation and a traveling radiation-type structure providing a horizontal polarization radiation.

According to an embodiment of the present disclosure, the traveling radiation-type structure may be formed as a portion of the aperture radiation-type structure.

According to an embodiment of the present disclosure, the aperture radiation-type structure may include a waveguide having a surface configured of an aperture, a first antenna disposed inside the waveguide, and a first power feeding port extending from the power feeding line and feeding power to the first antenna.

According to an embodiment of the present disclosure, the traveling radiation-type structure may include a slot line disposed in a lengthwise direction of the waveguide, a second antenna disposed on the slot line, and a second power feeding port extending from the power feeding line and feeding power to the second antenna.

According to an embodiment of the present disclosure, each of the dual-type antenna elements may be configured to provide the beamforming through polarization agility.

According to an embodiment of the present disclosure, the beamforming through the polarization agility may be performed by phase-controlled feeding the dual-type antenna elements.

According to an embodiment of the present disclosure, the first antenna may include a probe shape, and the second antenna may include a tapered slot shape, and the first antenna and the second antenna may be arranged to be orthogonal to each other.

According to an embodiment of the present disclosure, the mmWave antenna module may further comprise a circuit board formed of one of a PCB and a LTCC. The dual-type antenna elements may be formed in a portion positioned adjacent an edge of the circuit board. The portion may function as a dielectric transformer matching the antenna elements.

According to an embodiment of the present disclosure, the plurality of power feeding lines may have a stacked structure of feed lines for the antenna elements.

According to an embodiment of the present disclosure, a wireless communication device and/or electronic device including an antenna device (e.g., a polarization-agile phased-array antenna) may include a mmWave antenna module including a plurality of antenna elements and a housing 100 including at least one opening matching the antenna module with an outer space. The mmWave antenna module may include a plurality of antenna elements, an RFIC, and a power feeding line. The plurality of antenna elements may be dual-type antenna elements configured to excite polarization modes orthogonal to each other. The power feeding line may allow a plurality of ports of the RFIC to individually connect to the plurality of dual-type antenna elements to excite the orthogonal polarization modes to perform beamforming. The mmWave antenna module may be separated from the outer space by the housing and may radiate an electromagnetic wave through conductive patterns of the housing to the outer space.

According to an embodiment of the present disclosure, the conductive structure forming the conductive patterns may form at least some of side walls of the housing 100.

According to an embodiment of the present disclosure, the dual-type antenna elements may be configured of an aperture radiation-type structure including a first antenna providing a polarization radiation in a first direction and a traveling radiation-type structure including a second antenna providing a polarization radiation in a second direction different from the first direction.

According to an embodiment of the present disclosure, the housing 100 may further include a metal frame, and the metal frame may match the waveguide with the outer space.

According to an embodiment of the present disclosure, the housing 100 may further include a metal frame. A side of the waveguide filled with a plastic may be exposed to the outer space.

According to an embodiment of the present disclosure, the housing may accommodate the plurality of antenna elements and may include a metallic conductive structure. The conductive structure may form at least a portion of side walls of the housing 100.

According to an embodiment of the present disclosure, the wireless communication device may further comprise a leaky wave radiator matching the antenna module with the outer space of the housing 100.

According to an embodiment of the present disclosure, the leaky wave radiator may include an array of a plurality of openings formed in the conductive structure.

According to an embodiment of the present disclosure, the wireless communication device may operate in at least one beamforming mode of an array mode by an array of the antenna elements, a leaky wave mode by the leaky wave radiator, and a mixed mode by a combination of the array mode and the leaky wave mode.

While the present disclosure has been shown and described with reference to various embodiments thereof, it will be understood by those of skilled in the art that various changes in form and details may be made therein without departing from the spirit and scope of the present disclosure as defined by the appended claims and their equivalents.

What is claimed is:

1. A millimeter wave (mmWave) antenna comprising:

a plurality of antenna elements;

a radio frequency integrated circuit (RFIC); and a plurality of power feeding lines, wherein the plurality of antenna elements are dual-type antenna elements configured to excite different polarization modes, wherein the plurality of power feeding lines allow a plurality of ports of the RFIC to individually connect to the plurality of dual-type antenna elements to excite the different polarization modes to perform beamforming, and wherein the plurality of power feeding lines are stacked to form a stacked structure of feed lines for connecting to the dual-type antenna elements.

2. The mmWave antenna of claim 1, wherein each of the dual-type antenna elements comprises:

an aperture radiation-type structure providing a vertical polarization radiation, and a traveling radiation-type structure providing a horizontal polarization radiation.

3. The mmWave antenna of claim 2, wherein the traveling radiation-type structure is formed as a portion of the aperture radiation-type structure.

4. The mmWave antenna of claim 2, wherein the aperture radiation-type structure comprises:

a waveguide having a surface including an aperture, a first antenna disposed inside the waveguide, and a first power feeding port extending from the power feeding line to the first antenna.

5. The mmWave antenna of claim 4, wherein the traveling radiation-type structure comprises:

a slot line disposed in a lengthwise direction of the waveguide, a second antenna disposed on the slot line, and a second power feeding port extending from the power feeding line to the second antenna.

6. The mmWave antenna of claim 5, wherein the first antenna includes a probe shape, wherein the second antenna has a tapered slot shape, and wherein the first antenna and the second antenna are arranged to be orthogonal to each other.

7. The mmWave antenna of claim 5, further comprising:

a circuit board formed of one of a printed circuit board (PCB) and a low temperature co-fired ceramic (LTCC), wherein the dual-type antenna elements are formed in a portion positioned adjacent an edge of the circuit board, and wherein the portion may function as a dielectric transformer matching the antenna elements.

8. The mmWave antenna of claim 2, wherein each of the dual-type antenna elements is configured to provide the beamforming through polarization agility.

9. The mmWave antenna of claim 8, wherein the beamforming through the polarization agility is performed by phase-controlled feeding of the dual-type antenna elements.

10. The mmWave antenna of claim 2, further comprising:

a first metal screen on a first side of the plurality of antenna elements; and a second metal screen on a second side of the plurality of antenna elements opposite to the first side of the plurality of antenna elements.

11. The mmWave antenna of claim 10, wherein the first metal screen and the second metal screen are configured to provide an electromagnetic shield to the plurality of antenna elements.

12. A millimeter wave (mmWave) antenna comprising:

a substrate;

a plurality of first antenna elements arranged in a first direction and exciting a first polarization mode;

a plurality of second antenna elements arranged in a second direction and exciting a second polarization mode different from the first polarization mode;

a plurality of first power feeding lines connected with the first antenna elements; and a plurality of second power feeding lines connected with the second antenna elements, wherein the plurality of first antenna elements and the plurality of second antenna elements are alternately arranged one over another on the substrate and the plurality of first power feeding lines and the plurality of second power feeding lines are alternately arranged thereunder.

13. A wireless communication device comprising:

a millimeter wave (mmWave) antenna comprising a plurality of antenna elements; and a housing including at least one opening matching the mmWave antenna with an outer space, wherein the mmWave antenna comprising:

a radio frequency integrated circuit (RFIC); and a plurality of power feeding lines, wherein the plurality of antenna elements are dual-type antenna elements configured to excite polarization modes orthogonal to each other, wherein the plurality of power feeding lines are configured to individually couple a plurality of ports of the RFIC to the plurality of dual-type antenna elements to excite the orthogonal polarization modes to perform beamforming, and wherein the mmWave antenna is separated from the outer space by the housing and is configured to electromagnetically couple conductive patterns of the housing to the at least one opening for radiating an electromagnetic wave through the conductive patterns of the housing.

14. The wireless communication device of claim 13, wherein the housing further comprises a sidewall having a conductive structure, and wherein the conductive structure comprises the conductive patterns.

15. The wireless communication device of claim 14, wherein each of the dual-type antenna elements comprises:

an aperture radiation-type structure including a first antenna providing a polarization radiation in a first direction, and a traveling radiation-type structure including a second antenna providing a polarization radiation in a second direction different from the first direction.

16. The wireless communication device of claim 13, wherein the housing further includes a metal frame, and wherein the metal frame matches a waveguide with the outer space.

17. The wireless communication device of claim 13, wherein the housing further includes a metal frame, and wherein a side of a waveguide comprises a plastic material exposed to the outer space.

18. The wireless communication device of claim 13, wherein the housing accommodates the plurality of antenna elements, wherein the housing comprises:

a metallic conductive structure, and a plurality of sidewalls, and wherein the conductive structure forms at least a portion of a side wall of a plurality of side walls.

19. The wireless communication device of claim 18, further comprising a leaky wave radiator matching the mmWave antenna with the outer space of the housing.

* * * * *